US012661553B2

(12) United States Patent
Nielsen et al.

(10) Patent No.: US 12,661,553 B2
(45) Date of Patent: Jun. 23, 2026

(54) EXERCISE LEADERBOARD

(71) Applicant: iFIT Inc., Logan, UT (US)

(72) Inventors: Rebecca Lynn Nielsen, Millville, UT (US); Chase Brammer, Providence, UT (US); Craig Stapley, Lake Havasu City, UT (US); Dustin Sanders, Logan, UT (US)

( * ) Notice: Subject to any disclaimer, the term of this patent is extended or adjusted under 35 U.S.C. 154(b) by 394 days.

(21) Appl. No.: 18/210,505

(22) Filed: Jun. 15, 2023

(65) Prior Publication Data

US 2024/0024734 A1 Jan. 25, 2024

Related U.S. Application Data

(60) Provisional application No. 63/352,539, filed on Jun. 15, 2022.

(51) Int. Cl.
*A63B 24/00* (2006.01)
*A63B 71/06* (2006.01)

(52) U.S. Cl.
CPC ..... *A63B 24/0062* (2013.01); *A63B 71/0616* (2013.01); *A63B 71/0622* (2013.01); *A63B 2024/0068* (2013.01)

(58) Field of Classification Search
CPC ..... A63B 24/0062; A63B 71/0616; A63B 71/0622; A63B 2024/0068
USPC ..... 700/92
See application file for complete search history.

(56) References Cited

U.S. PATENT DOCUMENTS

| | | | |
|---|---|---|---|
| 3,123,646 | A | 3/1964 | Easton |
| 3,579,339 | A | 5/1971 | Chang et al. |
| 4,023,795 | A | 5/1977 | Pauls |
| 4,300,760 | A | 11/1981 | Bobroff |
| D286,311 | S | 10/1986 | Martinell et al. |
| 4,681,318 | A | 7/1987 | Lay |
| 4,684,126 | A | 8/1987 | Dalebout et al. |
| 4,728,102 | A | 3/1988 | Pauls |
| 4,750,736 | A | 6/1988 | Watterson |
| 4,796,881 | A | 1/1989 | Watterson |
| 4,813,667 | A | 3/1989 | Watterson |

(Continued)

OTHER PUBLICATIONS

U.S. Appl. No. 17/066,485, filed Oct. 9, 2020, Weston et al.

(Continued)

*Primary Examiner* — Allen Chan
(74) *Attorney, Agent, or Firm* — Holland & Hart LLP

(57) ABSTRACT

A non-transitory computer-readable medium may contain instructions which, when executed by a processor, cause the processor to receive a user profile of a first user of an exercise device, receive user profiles of a plurality of users, assign weights to the user profiles of the plurality of users, and, using the assigned weights, rank the plurality of users based on similarity to the first user. The instructions may further cause the processor to select a subset of the ranked plurality of users, determine performance metrics of the ranked plurality of users for a workout program, determine performance metrics of the first user during execution of the workout program and cause to be displayed, on a display of the exercise device, during execution of the workout program, a comparison of the performance metrics of the first user and the performance metrics of the selected subset of the ranked plurality of users.

20 Claims, 46 Drawing Sheets

(56) References Cited

U.S. PATENT DOCUMENTS 4,830,371 A 5/1989 Lay
4,844,451 A 7/1989 Bersonnet et al.
4,850,585 A 7/1989 Dalebout et al.
D304,849 S 11/1989 Watterson
4,880,225 A 11/1989 Lucas et al.
4,883,272 A 11/1989 Lay
D306,468 S 3/1990 Watterson
D306,891 S 3/1990 Watterson
4,913,396 A 4/1990 Dalebout et al.
D307,614 S 5/1990 Bingham et al.
D307,615 S 5/1990 Bingham et al.
4,921,242 A 5/1990 Watterson
4,932,650 A 6/1990 Bingham et al.
D309,167 S 7/1990 Griffin
D309,485 S 7/1990 Bingham et al.
4,938,478 A 7/1990 Lay
D310,253 S 8/1990 Bersonnet et al.
4,955,599 A 9/1990 Bersonnet et al.
4,971,316 A 11/1990 Dalebout et al.
D313,055 S 12/1990 Watterson
4,974,832 A 12/1990 Dalebout
4,979,737 A 12/1990 Kock
4,981,294 A 1/1991 Dalebout et al.
D315,765 S 3/1991 Measom et al.
4,998,725 A 3/1991 Watterson et al.
5,000,442 A 3/1991 Dalebout et al.
5,000,443 A 3/1991 Dalebout et al.
5,000,444 A 3/1991 Dalebout et al.
D316,124 S 4/1991 Dalebout et al.
5,013,033 A 5/1991 Watterson et al.
5,014,980 A 5/1991 Bersonnet et al.
5,016,871 A 5/1991 Dalebout et al.
D318,085 S 7/1991 Jacobson et al.
D318,086 S 7/1991 Bingham et al.
D318,699 S 7/1991 Jacobson et al.
5,029,801 A 7/1991 Dalebout et al.
5,034,576 A 7/1991 Dalebout et al.
5,058,881 A 10/1991 Measom
5,058,882 A 10/1991 Dalebout et al.
D321,388 S 11/1991 Dalebout
5,062,626 A 11/1991 Dalebout et al.
5,062,627 A 11/1991 Bingham
5,062,632 A 11/1991 Dalebout et al.
5,062,633 A 11/1991 Engel et al.
5,067,710 A 11/1991 Watterson et al.
5,072,929 A 12/1991 Peterson et al.
D323,009 S 1/1992 Dalebout et al.
D323,198 S 1/1992 Dalebout et al.
D323,199 S 1/1992 Dalebout et al.
D323,863 S 2/1992 Watterson
5,088,729 A 2/1992 Dalebout
5,090,694 A 2/1992 Pauls et al.
5,102,380 A 4/1992 Jacobson et al.
5,104,120 A 4/1992 Watterson et al.
5,108,093 A 4/1992 Watterson
D326,491 S 5/1992 Dalebout
5,122,105 A 6/1992 Engel et al.
5,135,216 A 8/1992 Bingham et al.
5,147,265 A 9/1992 Pauls et al.
5,149,084 A 9/1992 Dalebout et al.
5,149,312 A 9/1992 Croft et al.
5,171,196 A 12/1992 Lynch
D332,347 S 1/1993 Raadt et al.
5,190,505 A 3/1993 Dalebout et al.
5,192,255 A 3/1993 Dalebout et al.
5,195,937 A 3/1993 Engel et al.
5,203,826 A 4/1993 Dalebout
D335,511 S 5/1993 Engel et al.
D335,905 S 5/1993 Cutter et al.
D336,498 S 6/1993 Engel et al.
5,217,487 A 6/1993 Engel et al.
D337,361 S 7/1993 Engel et al.
D337,666 S 7/1993 Peterson et al.
D337,799 S 7/1993 Cutter et al.
5,226,866 A 7/1993 Engel et al.
5,244,446 A 9/1993 Engel et al.
5,247,853 A 9/1993 Dalebout
5,259,611 A 11/1993 Dalebout et al.
D342,106 S 12/1993 Campbell et al.
5,279,528 A 1/1994 Dalebout et al.
D344,112 S 2/1994 Smith
D344,557 S 2/1994 Ashby
5,282,776 A 2/1994 Dalebout
5,295,931 A 3/1994 Dreibelbis et al.
5,302,161 A 4/1994 Loubert et al.
D347,251 S 5/1994 Dreibelbis et al.
5,316,534 A 5/1994 Dalebout et al.
D348,493 S 7/1994 Ashby
D348,494 S 7/1994 Ashby
5,328,164 A 7/1994 Soga
D349,931 S 8/1994 Bostic et al.
5,336,142 A 8/1994 Dalebout et al.
5,344,376 A 9/1994 Bostic et al.
D351,202 S 10/1994 Bingham
D351,435 S 10/1994 Peterson et al.
D351,633 S 10/1994 Bingham
D352,534 S 11/1994 Dreibelbis et al.
D353,422 S 12/1994 Bostic et al.
5,372,559 A 12/1994 Dalebout et al.
5,374,228 A 12/1994 Buisman et al.
5,382,221 A 1/1995 Hsu et al.
5,387,168 A 2/1995 Bostic
5,393,690 A 2/1995 Fu et al.
D356,128 S 3/1995 Smith et al.
5,409,435 A 4/1995 Daniels
5,429,563 A 7/1995 Engel et al.
5,431,612 A 7/1995 Holden
D360,915 S 8/1995 Bostic et al.
5,468,205 A 11/1995 McFall et al.
5,489,249 A 2/1996 Brewer et al.
5,492,517 A 2/1996 Bostic et al.
D367,689 S 3/1996 Wilkinson et al.
5,511,740 A 4/1996 Loubert et al.
5,512,025 A 4/1996 Dalebout et al.
D370,949 S 6/1996 Furner
D371,176 S 6/1996 Furner
5,527,245 A 6/1996 Dalebout et al.
5,529,553 A 6/1996 Finlayson
5,540,429 A 7/1996 Dalebout et al.
5,549,533 A 8/1996 Olson et al.
5,554,085 A 9/1996 Dalebout
5,569,128 A 10/1996 Dalebout
5,591,105 A 1/1997 Dalebout et al.
5,591,106 A 1/1997 Dalebout et al.
5,595,556 A 1/1997 Dalebout et al.
5,607,375 A 3/1997 Dalebout et al.
5,611,539 A 3/1997 Watterson et al.
5,622,527 A 4/1997 Watterson et al.
5,626,538 A 5/1997 Dalebout et al.
5,626,542 A 5/1997 Dalebout et al.
D380,024 S 6/1997 Novak et al.
5,637,059 A 6/1997 Dalebout
D380,509 S 7/1997 Wilkinson et al.
5,643,153 A 7/1997 Nylen et al.
5,645,509 A 7/1997 Brewer et al.
D384,118 S 9/1997 Deblauw
5,662,557 A 9/1997 Watterson et al.
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,331 A 11/1997 Dalebout
5,683,332 A 11/1997 Watterson et al.
D387,825 S 12/1997 Fleck et al.
5,695,433 A 12/1997 Buisman
5,695,434 A 12/1997 Dalebout et al.
5,695,435 A 12/1997 Dalebout et al.
5,702,325 A 12/1997 Watterson et al.
5,704,879 A 1/1998 Watterson et al.
5,718,657 A 2/1998 Dalebout et al.
5,720,200 A 2/1998 Anderson et al.
5,720,698 A 2/1998 Dalebout et al.
D392,006 S 3/1998 Dalebout et al.

(56) References Cited

U.S. PATENT DOCUMENTS 5,722,922 A 3/1998 Watterson et al.
5,733,229 A 3/1998 Dalebout et al.
5,743,833 A 4/1998 Watterson et al.
5,762,584 A 6/1998 Daniels
5,762,587 A 6/1998 Dalebout et al.
5,772,560 A 6/1998 Watterson et al.
5,810,698 A 9/1998 Hullett et al.
5,827,155 A 10/1998 Jensen et al.
5,830,114 A 11/1998 Halfen et al.
5,860,893 A 1/1999 Watterson et al.
5,860,894 A 1/1999 Dalebout et al.
5,899,834 A 5/1999 Dalebout et al.
D412,953 S 8/1999 Armstrong
D413,948 S 9/1999 Dalebout
5,951,441 A 9/1999 Dalebout et al.
5,951,448 A 9/1999 Bolland
D416,596 S 11/1999 Armstrong
6,003,166 A 12/1999 Hald et al.
6,019,710 A 2/2000 Dalebout et al.
6,027,429 A 2/2000 Daniels
6,033,347 A 3/2000 Dalebout et al.
D425,940 S 5/2000 Halfen et al.
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout et al.
6,193,631 B1 2/2001 Hickman
6,228,003 B1 5/2001 Hald et al.
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout et al.
6,312,363 B1 11/2001 Watterson et al.
D452,338 S 12/2001 Dalebout et al.
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris et al.
6,422,980 B1 7/2002 Simonson
6,447,424 B1 9/2002 Ashby et al.
6,458,060 B1 10/2002 Watterson et al.
6,458,061 B2 10/2002 Simonson
6,471,622 B1 10/2002 Hammer et al.
6,563,225 B2 5/2003 Soga et al.
6,601,016 B1 7/2003 Brown et al.
6,623,140 B2 9/2003 Watterson et al.
6,626,799 B2 9/2003 Watterson et al.
6,652,424 B2 11/2003 Dalebout
6,685,607 B1 2/2004 Olson
6,695,581 B2 2/2004 Wasson et al.
6,701,271 B2 3/2004 Willner et al.
6,702,719 B1 3/2004 Brown et al.
6,712,740 B2 3/2004 Simonson
6,730,002 B2 5/2004 Hald et al.
6,743,153 B2 6/2004 Watterson et al.
6,746,371 B1 6/2004 Brown et al.
6,749,537 B1 6/2004 Hickman
6,761,667 B1 7/2004 Cutler et al.
6,770,015 B2 8/2004 Simonson
6,786,852 B2 9/2004 Watterson et al.
6,808,472 B1 10/2004 Hickman
6,821,230 B2 11/2004 Dalebout et al.
6,830,540 B2 12/2004 Watterson et al.
6,863,641 B1 3/2005 Brown et al.
6,866,613 B1 3/2005 Brown et al.
6,875,160 B2 4/2005 Watterson et al.
D507,311 S 7/2005 Butler et al.
6,918,858 B2 7/2005 Watterson et al.
6,921,351 B1 7/2005 Hickman et al.
6,974,404 B1 12/2005 Watterson et al.
6,997,852 B2 2/2006 Watterson et al.
7,025,713 B2 4/2006 Dalebout et al.
D520,085 S 5/2006 Willardson et al.
7,044,897 B2 5/2006 Myers et al.
7,052,442 B2 5/2006 Watterson et al.
7,060,006 B1 6/2006 Watterson et al.
7,060,008 B2 6/2006 Watterson et al.
7,070,539 B2 7/2006 Brown et al.
7,097,588 B2 8/2006 Watterson et al.
D527,776 S 9/2006 Willardson et al.
7,112,168 B2 9/2006 Dalebout et al.
7,128,693 B2 10/2006 Brown et al.
7,166,062 B1 1/2007 Watterson et al.
7,166,064 B2 1/2007 Watterson et al.
7,169,087 B2 1/2007 Ercanbrack et al.
7,169,093 B2 1/2007 Simonson et al.
7,192,388 B2 3/2007 Dalebout et al.
7,250,022 B2 7/2007 Dalebout et al.
7,282,016 B2 10/2007 Simonson
7,285,075 B2 10/2007 Cutler et al.
7,344,481 B2 3/2008 Watterson et al.
7,377,882 B2 5/2008 Watterson et al.
7,425,188 B2 9/2008 Ercanbrack et al.
7,429,236 B2 9/2008 Dalebout et al.
7,455,622 B2 11/2008 Watterson et al.
7,482,050 B2 1/2009 Olson
D588,655 S 3/2009 Utykanski
7,510,509 B2 3/2009 Hickman
7,537,546 B2 5/2009 Watterson et al.
7,537,549 B2 5/2009 Nelson et al.
7,537,552 B2 5/2009 Dalebout et al.
7,540,828 B2 6/2009 Watterson et al.
7,549,947 B2 6/2009 Hickman et al.
7,556,590 B2 7/2009 Watterson et al.
7,563,203 B2 7/2009 Dalebout et al.
7,575,536 B1 8/2009 Hickman
7,601,105 B1 10/2009 Gipson et al.
7,604,573 B2 10/2009 Dalebout et al.
D604,373 S 11/2009 Dalebout et al.
7,618,350 B2 11/2009 Dalebout et al.
7,618,357 B2 11/2009 Dalebout et al.
7,625,315 B2 12/2009 Hickman
7,625,321 B2 12/2009 Simonson et al.
7,628,730 B1 12/2009 Watterson et al.
7,628,737 B2 12/2009 Kowallis et al.
7,637,847 B1 12/2009 Hickman
7,645,212 B2 1/2010 Ashby et al.
7,645,213 B2 1/2010 Watterson et al.
7,658,698 B2 2/2010 Pacheco et al.
7,674,205 B2 3/2010 Dalebout et al.
7,713,171 B1 5/2010 Hickman
7,713,172 B2 5/2010 Watterson et al.
7,713,180 B2 5/2010 Wickens et al.
7,717,828 B2 5/2010 Simonson et al.
7,736,279 B2 6/2010 Dalebout et al.
7,740,563 B2 6/2010 Dalebout et al.
7,749,144 B2 7/2010 Hammer
7,766,797 B2 8/2010 Dalebout et al.
7,771,329 B2 8/2010 Dalebout et al.
7,775,940 B2 8/2010 Dalebout et al.
7,789,800 B1 9/2010 Watterson et al.
7,798,946 B2 9/2010 Dalebout et al.
7,815,550 B2 10/2010 Watterson et al.
7,857,731 B2 12/2010 Hickman et al.
7,862,475 B2 1/2011 Watterson et al.
7,862,478 B2 1/2011 Watterson et al.
7,862,483 B2 1/2011 Hendrickson et al.
D635,207 S 3/2011 Dalebout et al.
7,901,330 B2 3/2011 Dalebout et al.
7,909,740 B2 3/2011 Dalebout et al.
7,980,996 B2 7/2011 Hickman
7,981,000 B2 7/2011 Watterson et al.
7,985,164 B2 7/2011 Ashby
8,029,415 B2 10/2011 Ashby et al.
8,033,960 B1 10/2011 Dalebout et al.
D650,451 S 12/2011 Olson et al.
D652,877 S 1/2012 Dalebout et al.
8,152,702 B2 4/2012 Pacheco
D659,775 S 5/2012 Olson et al.

(56) References Cited

U.S. PATENT DOCUMENTS

| | | | |
|---|---|---|---|
| D659,777 | S | 5/2012 | Watterson et al. |
| D660,383 | S | 5/2012 | Watterson et al. |
| D664,613 | S | 7/2012 | Dalebout et al. |
| 8,251,874 | B2 | 8/2012 | Ashby et al. |
| 8,298,123 | B2 | 10/2012 | Hickman |
| 8,298,125 | B2 | 10/2012 | Colledge et al. |
| D671,177 | S | 11/2012 | Sip |
| D671,178 | S | 11/2012 | Sip |
| D673,626 | S | 1/2013 | Olson et al. |
| 8,690,735 | B2 | 4/2014 | Watterson et al. |
| D707,763 | S | 6/2014 | Cutler |
| 8,740,753 | B2 | 6/2014 | Olson et al. |
| 8,758,201 | B2 | 6/2014 | Ashby et al. |
| 8,771,153 | B2 | 7/2014 | Dalebout et al. |
| 8,784,270 | B2 | 7/2014 | Ashby et al. |
| 8,808,148 | B2 | 8/2014 | Watterson et al. |
| 8,814,762 | B2 | 8/2014 | Butler et al. |
| D712,493 | S | 9/2014 | Ercanbrack et al. |
| 8,840,075 | B2 | 9/2014 | Dalebout et al. |
| 8,845,493 | B2 | 9/2014 | Watterson et al. |
| 8,870,726 | B2 | 10/2014 | Watterson et al. |
| 8,876,668 | B2 | 11/2014 | Hendrickson et al. |
| 8,894,549 | B2 | 11/2014 | Colledge |
| 8,894,555 | B2 | 11/2014 | Colledge et al. |
| 8,911,330 | B2 | 12/2014 | Watterson et al. |
| 8,920,288 | B2 | 12/2014 | Dalebout et al. |
| 8,986,165 | B2 | 3/2015 | Ashby |
| 8,992,364 | B2 | 3/2015 | Law et al. |
| 8,992,387 | B2 | 3/2015 | Watterson et al. |
| D726,476 | S | 4/2015 | Ercanbrack |
| 9,028,368 | B2 | 5/2015 | Ashby et al. |
| 9,028,370 | B2 | 5/2015 | Watterson et al. |
| 9,039,578 | B2 | 5/2015 | Dalebout |
| D731,011 | S | 6/2015 | Buchanan |
| 9,072,930 | B2 | 7/2015 | Ashby et al. |
| 9,119,983 | B2 | 9/2015 | Rhea |
| 9,123,317 | B2 | 9/2015 | Watterson et al. |
| 9,126,071 | B2 | 9/2015 | Smith |
| 9,126,072 | B2 | 9/2015 | Watterson |
| 9,138,615 | B2 | 9/2015 | Olson et al. |
| 9,142,139 | B2 | 9/2015 | Watterson et al. |
| 9,144,703 | B2 | 9/2015 | Dalebout et al. |
| 9,149,683 | B2 | 10/2015 | Watterson et al. |
| 9,186,535 | B2 | 11/2015 | Ercanbrack |
| 9,186,549 | B2 | 11/2015 | Watterson et al. |
| 9,254,409 | B2 | 2/2016 | Dalebout et al. |
| 9,254,416 | B2 | 2/2016 | Ashby |
| 9,278,248 | B2 | 3/2016 | Tyger et al. |
| 9,278,249 | B2 | 3/2016 | Watterson |
| 9,278,250 | B2 | 3/2016 | Buchanan |
| 9,289,648 | B2 | 3/2016 | Watterson |
| 9,339,691 | B2 | 5/2016 | Brammer |
| 9,352,185 | B2 | 5/2016 | Hendrickson et al. |
| 9,352,186 | B2 | 5/2016 | Watterson |
| 9,375,605 | B2 | 6/2016 | Tyger et al. |
| 9,381,394 | B2 | 7/2016 | Mortensen et al. |
| 9,387,387 | B2 | 7/2016 | Dalebout |
| 9,393,453 | B2 | 7/2016 | Watterson |
| 9,403,047 | B2 | 8/2016 | Olson et al. |
| 9,403,051 | B2 | 8/2016 | Cutler |
| 9,421,416 | B2 | 8/2016 | Mortensen et al. |
| 9,457,219 | B2 | 10/2016 | Smith |
| 9,457,220 | B2 | 10/2016 | Olson |
| 9,457,222 | B2 | 10/2016 | Dalebout |
| 9,460,632 | B2 | 10/2016 | Watterson |
| 9,463,356 | B2 | 10/2016 | Rhea |
| 9,468,794 | B2 | 10/2016 | Barton |
| 9,468,798 | B2 | 10/2016 | Dalebout |
| 9,480,874 | B2 | 11/2016 | Cutler |
| 9,492,704 | B2 | 11/2016 | Mortensen et al. |
| 9,498,668 | B2 | 11/2016 | Smith |
| 9,517,378 | B2 | 12/2016 | Ashby et al. |
| 9,521,901 | B2 | 12/2016 | Dalebout |
| 9,533,187 | B2 | 1/2017 | Dalebout |
| 9,539,461 | B2 | 1/2017 | Ercanbrack |
| 9,579,544 | B2 | 2/2017 | Watterson |
| 9,586,086 | B2 | 3/2017 | Dalebout et al. |
| 9,586,090 | B2 | 3/2017 | Watterson et al. |
| 9,604,099 | B2 | 3/2017 | Taylor |
| 9,616,276 | B2 | 4/2017 | Dalebout et al. |
| 9,616,278 | B2 | 4/2017 | Olson |
| 9,623,281 | B2 | 4/2017 | Hendrickson et al. |
| 9,636,567 | B2 | 5/2017 | Brammer et al. |
| 9,675,839 | B2 | 6/2017 | Dalebout et al. |
| 9,682,307 | B2 | 6/2017 | Dalebout |
| 9,694,234 | B2 | 7/2017 | Dalebout et al. |
| 9,694,242 | B2 | 7/2017 | Ashby et al. |
| 9,737,755 | B2 | 8/2017 | Dalebout |
| 9,757,605 | B2 | 9/2017 | Olson et al. |
| 9,764,186 | B2 | 9/2017 | Dalebout et al. |
| 9,767,785 | B2 | 9/2017 | Ashby et al. |
| 9,795,822 | B2 | 10/2017 | Smith et al. |
| 9,808,672 | B2 | 11/2017 | Dalebout |
| 9,849,326 | B2 | 12/2017 | Smith |
| 9,878,210 | B2 | 1/2018 | Watterson |
| 9,889,334 | B2 | 2/2018 | Ashby et al. |
| 9,889,339 | B2 | 2/2018 | Douglass |
| 9,937,376 | B2 | 4/2018 | McInelly et al. |
| 9,937,377 | B2 | 4/2018 | McInelly et al. |
| 9,937,378 | B2 | 4/2018 | Dalebout et al. |
| 9,937,379 | B2 | 4/2018 | Mortensen et al. |
| 9,943,719 | B2 | 4/2018 | Smith et al. |
| 9,943,722 | B2 | 4/2018 | Dalebout |
| 9,948,037 | B2 | 4/2018 | Ashby |
| 9,968,816 | B2 | 5/2018 | Olson et al. |
| 9,968,821 | B2 | 5/2018 | Finlayson et al. |
| 9,968,823 | B2 | 5/2018 | Cutler |
| 10,010,755 | B2 | 7/2018 | Watterson |
| 10,010,756 | B2 | 7/2018 | Watterson |
| 10,029,145 | B2 | 7/2018 | Douglass |
| D826,350 | S | 8/2018 | Hochstrasser |
| 10,042,893 | B2 * | 8/2018 | Thurston ..... G06F 16/24578 |
| 10,046,196 | B2 | 8/2018 | Ercanbrack et al. |
| D827,733 | S | 9/2018 | Hochstrasser |
| 10,065,064 | B2 | 9/2018 | Smith et al. |
| 10,071,285 | B2 | 9/2018 | Smith et al. |
| 10,085,586 | B2 | 10/2018 | Smith et al. |
| 10,086,254 | B2 | 10/2018 | Watterson |
| 10,136,842 | B2 | 11/2018 | Ashby |
| 10,186,161 | B2 | 1/2019 | Watterson |
| 10,188,890 | B2 | 1/2019 | Olson et al. |
| 10,207,143 | B2 | 2/2019 | Dalebout et al. |
| 10,207,145 | B2 | 2/2019 | Tyger et al. |
| 10,207,147 | B2 | 2/2019 | Ercanbrack et al. |
| 10,207,148 | B2 | 2/2019 | Powell et al. |
| 10,212,994 | B2 | 2/2019 | Watterson et al. |
| 10,220,259 | B2 | 3/2019 | Brammer |
| 10,226,396 | B2 | 3/2019 | Ashby |
| 10,226,664 | B2 | 3/2019 | Dalebout et al. |
| 10,252,109 | B2 | 4/2019 | Watterson |
| 10,258,828 | B2 | 4/2019 | Dalebout et al. |
| 10,272,317 | B2 | 4/2019 | Watterson |
| 10,279,212 | B2 | 5/2019 | Dalebout et al. |
| 10,293,211 | B2 | 5/2019 | Watterson et al. |
| D852,292 | S | 6/2019 | Cutler |
| 10,343,017 | B2 | 7/2019 | Jackson |
| 10,376,736 | B2 | 8/2019 | Powell et al. |
| 10,388,183 | B2 | 8/2019 | Watterson |
| 10,391,361 | B2 | 8/2019 | Watterson |
| D864,320 | S | 10/2019 | Weston |
| D864,321 | S | 10/2019 | Weston |
| 10,426,989 | B2 | 10/2019 | Dalebout |
| 10,433,612 | B2 | 10/2019 | Ashby et al. |
| 10,441,840 | B2 | 10/2019 | Dalebout |
| 10,441,844 | B2 | 10/2019 | Powell |
| 10,449,416 | B2 | 10/2019 | Dalebout et al. |
| 10,471,299 | B2 | 11/2019 | Powell |
| D868,909 | S | 12/2019 | Cutler et al. |
| 10,492,519 | B2 | 12/2019 | Capell et al. |
| 10,493,349 | B2 | 12/2019 | Watterson |
| 10,500,473 | B2 | 12/2019 | Watterson |
| 10,537,764 | B2 | 1/2020 | Smith et al. |
| 10,543,395 | B2 | 1/2020 | Powell et al. |
| 10,561,877 | B2 | 2/2020 | Workman |

(56) References Cited

U.S. PATENT DOCUMENTS

| | | | | |
|---|---|---|---|---|
| 10,561,893 | B2 | 2/2020 | Chatterton et al. | |
| 10,561,894 | B2 | 2/2020 | Dalebout et al. | |
| 10,569,121 | B2 | 2/2020 | Watterson | |
| 10,569,123 | B2 | 2/2020 | Hochstrasser et al. | |
| 10,625,114 | B2 | 4/2020 | Ercanbrack | |
| 10,625,137 | B2 | 4/2020 | Dalebout et al. | |
| 10,661,114 | B2 | 5/2020 | Watterson et al. | |
| 10,668,320 | B2 | 6/2020 | Watterson | |
| 10,671,705 | B2 | 6/2020 | Capell et al. | |
| 10,688,346 | B2 | 6/2020 | Brammer | |
| 10,702,736 | B2 | 7/2020 | Weston et al. | |
| 10,709,925 | B2 | 7/2020 | Dalebout et al. | |
| 10,709,955 | B2 * | 7/2020 | Elford | A63B 71/0616 |
| 10,726,730 | B2 | 7/2020 | Watterson | |
| 10,729,965 | B2 | 8/2020 | Powell | |
| 10,758,767 | B2 | 9/2020 | Olson et al. | |
| 10,786,706 | B2 | 9/2020 | Smith | |
| 10,864,407 | B2 | 12/2020 | Watterson et al. | |
| 10,918,905 | B2 | 2/2021 | Powell et al. | |
| 10,932,517 | B2 | 3/2021 | Ashby et al. | |
| 10,940,360 | B2 | 3/2021 | Dalebout et al. | |
| 10,953,268 | B1 | 3/2021 | Dalebout et al. | |
| 10,953,305 | B2 | 3/2021 | Dalebout et al. | |
| 10,967,214 | B1 | 4/2021 | Olson et al. | |
| 10,994,173 | B2 | 5/2021 | Watterson | |
| 11,000,730 | B2 | 5/2021 | Dalebout et al. | |
| 11,013,960 | B2 | 5/2021 | Watterson et al. | |
| 11,033,777 | B1 | 6/2021 | Watterson et al. | |
| 11,058,913 | B2 | 7/2021 | Dalebout et al. | |
| 11,058,914 | B2 | 7/2021 | Powell | |
| 11,058,918 | B1 | 7/2021 | Watterson et al. | |
| 11,187,285 | B2 | 11/2021 | Wrobel | |
| 11,229,825 | B1 * | 1/2022 | Wachirajindakul | A63B 21/0728 |
| 11,298,577 | B2 | 4/2022 | Watterson | |
| 11,326,673 | B2 | 5/2022 | Buchanan | |
| 11,338,169 | B2 | 5/2022 | Dalebout et al. | |
| 11,338,175 | B2 | 5/2022 | Watterson et al. | |
| 11,426,633 | B2 | 8/2022 | Watterson et al. | |
| 11,451,108 | B2 | 9/2022 | Tinney | |
| 11,452,903 | B2 | 9/2022 | Watterson | |
| 11,511,152 | B2 | 11/2022 | Powell et al. | |
| 11,534,651 | B2 | 12/2022 | Ercanbrack et al. | |
| 11,534,654 | B2 | 12/2022 | Silcock et al. | |
| 11,534,655 | B2 | 12/2022 | Dalebout et al. | |
| 11,565,148 | B2 | 1/2023 | Dalebout et al. | |
| 11,596,830 | B2 | 3/2023 | Dalebout et al. | |
| 11,642,564 | B2 | 5/2023 | Watterson | |
| 11,673,036 | B2 | 6/2023 | Dalebout et al. | |
| 11,680,611 | B2 | 6/2023 | Wrobel | |
| 11,700,905 | B2 | 7/2023 | Ashby et al. | |
| 11,708,874 | B2 | 7/2023 | Wrobel | |
| 11,779,812 | B2 | 10/2023 | Watterson | |
| 11,794,052 | B2 | 10/2023 | Olson et al. | |
| 11,794,070 | B2 | 10/2023 | Hays et al. | |
| 11,794,075 | B2 | 10/2023 | Watterson et al. | |
| 2008/0051256 | A1 | 2/2008 | Ashby et al. | |
| 2015/0251055 | A1 | 9/2015 | Ashby | |
| 2016/0058335 | A1 | 3/2016 | Ashby | |
| 2016/0121074 | A1 | 5/2016 | Ashby | |
| 2016/0346595 | A1 | 12/2016 | Dalebout et al. | |
| 2017/0124912 | A1 | 5/2017 | Ashby et al. | |
| 2017/0193578 | A1 | 7/2017 | Watterson | |
| 2017/0266489 | A1 | 9/2017 | Douglass et al. | |
| 2017/0270820 | A1 | 9/2017 | Ashby et al. | |
| 2018/0085630 | A1 | 3/2018 | Capell et al. | |
| 2018/0099116 | A1 | 4/2018 | Ashby | |
| 2018/0099180 | A1 | 4/2018 | Wilkinson | |
| 2018/0111034 | A1 | 4/2018 | Watterson | |
| 2019/0223612 | A1 | 7/2019 | Watterson et al. | |
| 2019/0269971 | A1 | 9/2019 | Capell et al. | |
| 2020/0009417 | A1 | 1/2020 | Dalebout | |
| 2021/0001177 | A1 | 1/2021 | Smith | |
| 2021/0008413 | A1 * | 1/2021 | Asikainen | G06F 3/0304 |
| 2021/0046353 | A1 | 2/2021 | Dalebout et al. | |
| 2021/0106899 | A1 | 4/2021 | Willardson et al. | |
| 2021/0110910 | A1 | 4/2021 | Ostler et al. | |
| 2021/0146221 | A1 | 5/2021 | Dalebout et al. | |
| 2021/0225484 | A1 * | 7/2021 | Foley | G16Z 99/00 |
| 2021/0291013 | A1 | 9/2021 | Nascimento | |
| 2021/0299518 | A1 | 9/2021 | Brammer et al. | |
| 2021/0299520 | A1 * | 9/2021 | Evancha | A63B 24/0087 |
| 2021/0299542 | A1 | 9/2021 | Brammer et al. | |
| 2021/0339079 | A1 | 11/2021 | Dalebout et al. | |
| 2022/0062685 | A1 | 3/2022 | Ashby et al. | |
| 2022/0104992 | A1 | 4/2022 | Ashby | |
| 2022/0212052 | A1 | 7/2022 | Ercanbrack et al. | |
| 2022/0241649 | A1 | 8/2022 | Ashby | |
| 2022/0241665 | A1 | 8/2022 | Dalebout et al. | |
| 2022/0241668 | A1 | 8/2022 | Willardson et al. | |
| 2022/0249912 | A1 | 8/2022 | Watterson et al. | |
| 2022/0257994 | A1 | 8/2022 | Smith | |
| 2022/0258007 | A1 | 8/2022 | Watterson et al. | |
| 2022/0258008 | A1 | 8/2022 | Watterson et al. | |
| 2022/0266085 | A1 | 8/2022 | Dalebout et al. | |
| 2022/0280857 | A1 | 9/2022 | Watterson | |
| 2022/0309042 | A1 | 9/2022 | Archer | |
| 2022/0314078 | A1 | 10/2022 | Watterson et al. | |
| 2022/0323827 | A1 | 10/2022 | Watterson et al. | |
| 2022/0339493 | A1 | 10/2022 | Larsen | |
| 2022/0339520 | A1 | 10/2022 | Toth | |
| 2022/0342969 | A1 | 10/2022 | Watterson et al. | |
| 2022/0347516 | A1 | 11/2022 | Taylor | |
| 2022/0347548 | A1 | 11/2022 | Watterson | |
| 2022/0362613 | A1 | 11/2022 | Watterson et al. | |
| 2022/0362624 | A1 | 11/2022 | Dalebout | |
| 2022/0395729 | A1 | 12/2022 | Toth | |
| 2023/0039903 | A1 | 2/2023 | Brammer et al. | |
| 2023/0054845 | A1 | 2/2023 | Smith | |
| 2023/0122235 | A1 | 4/2023 | Ashby et al. | |
| 2023/0128721 | A1 | 4/2023 | Plummer | |
| 2023/0158358 | A1 | 5/2023 | Ercanbrack et al. | |
| 2023/0181993 | A1 | 6/2023 | Taylor et al. | |
| 2023/0191189 | A1 | 6/2023 | Taylor et al. | |
| 2023/0191197 | A1 | 6/2023 | Ashby | |
| 2023/0218975 | A1 | 7/2023 | Toles et al. | |
| 2023/0226401 | A1 | 7/2023 | Watterson | |
| 2023/0271056 | A1 | 8/2023 | Cutler et al. | |
| 2023/0277892 | A1 | 9/2023 | Smith et al. | |
| 2023/0285799 | A1 | 9/2023 | Dalebout et al. | |
| 2023/0304548 | A1 | 9/2023 | Wrobel | |
| 2023/0321482 | A1 | 10/2023 | Vasquez et al. | |
| 2023/0330476 | A1 | 10/2023 | Ashby et al. | |
| 2023/0360248 | A1 | 11/2023 | Ashby et al. | |

OTHER PUBLICATIONS

U.S. Appl. No. 17/739,819, filed May 9, 2022, Buchanan.
U.S. Appl. No. 17/841,313, filed Jun. 15, 2022, Weston et al.
U.S. Appl. No. 17/963,822, filed Oct. 11, 2022, Powell.
U.S. Appl. No. 18/091,004, filed Dec. 29, 2022, Cox.
U.S. Appl. No. 18/123,026, filed Mar. 17, 2023, Silcock et al.
U.S. Appl. No. 18/207,512, filed Jun. 8, 2023, Chuang.
U.S. Appl. No. 18/210,505, filed Jun. 15, 2023, Nielsen et al.
U.S. Appl. No. 18/242,840, filed Sep. 6, 2023, Brammer et al.
U.S. Appl. No. 18/482,491, filed Oct. 6, 2023, Willardson et al.
U.S. Appl. No. 29/702,127, filed Sep. 16, 2019, Cutler et al.
U.S. Appl. No. 62/273,852, filed Dec. 31, 2015, Watterson.
U.S. Appl. No. 63/073,081, filed Sep. 1, 2021, Ashby et al.
U.S. Appl. No. 63/079,697, filed Sep. 7, 2020, Willardson et al.
U.S. Appl. No. 63/086,793, filed Oct. 20, 2020, Ashby.
U.S. Appl. No. 63/134,036, filed Jan. 5, 2021, Ercanbrack et al.
U.S. Appl. No. 63/150,066, filed Feb. 16, 2021, Smith.
U.S. Appl. No. 63/156,801, filed Mar. 4, 2021, Watterson.
U.S. Appl. No. 63/165,498, filed Mar. 24, 2021, Archer.
U.S. Appl. No. 63/179,094, filed Apr. 23, 2021, Watterson et al.
U.S. Appl. No. 63/180,521, filed Apr. 27, 2021, Watterson et al.
U.S. Appl. No. 63/187,348, filed May 11, 2021, Dalebout et al.
U.S. Appl. No. 63/188,431, filed May 13, 2021, Plummer.
U.S. Appl. No. 63/200,903, filed Apr. 2, 2021, Watterson et al.
U.S. Appl. No. 63/211,870, filed Jun. 17, 2021, Watterson et al.

(56) References Cited

OTHER PUBLICATIONS

U.S. Appl. No. 63/216,313, filed Jun. 29, 2021, Watterson et al.
U.S. Appl. No. 63/229,794, filed Aug. 12, 2021, Brammer.
U.S. Appl. No. 63/235,002, filed Aug. 19, 2021, Smith.
U.S. Appl. No. 63/254,470, filed Oct. 11, 2021, Powell.
U.S. Appl. No. 63/278,714, filed Nov. 12, 2021, Taylor.
U.S. Appl. No. 63/289,997, filed Dec. 15, 2021, Taylor et al.
U.S. Appl. No. 63/290,455, filed Dec. 16, 2021, Taylor et al.
U.S. Appl. No. 63/290,557, filed Dec. 16, 2021, Ashby.
U.S. Appl. No. 63/298,170, filed Jan. 10, 2022, Ercanbrack et al.
U.S. Appl. No. 63/299,357, filed Jan. 13, 2022, Toles et al.
U.S. Appl. No. 63/305,976, filed Feb. 2, 2022, Watterson.
U.S. Appl. No. 63/329,270, filed Apr. 8, 2022, Vasquez et al.
U.S. Appl. No. 63/332,581, filed Apr. 25, 2022, Ashby et al.
U.S. Appl. No. 63/338,265, filed May 4, 2022, Ashby et al.
U.S. Appl. No. 63/350,072, filed Jun. 8, 2022, Chuang.
U.S. Appl. No. 63/352,539, filed Jun. 15, 2022, Nielsen et al.
U.S. Appl. No. 63/471,680, filed Jun. 7, 2023, Powell et al.

* cited by examiner

EXERCISE LEADERBOARD

This application claims the benefit and priority to U.S. Provisional Patent Application No. 63/352,539 filed Jun. 15, 2022, which application is incorporated herein by reference in its entirety for all it discloses.

BACKGROUND

Physical exercise has many salubrious benefits. However, many exercisers struggle to exercise consistently because they feel bored and unmotivated. Exercising with other people in a competitive environment can cause an exerciser to exercise harder and more consistently. However, the benefits of a competitive environment are lacking when an exerciser completes a workout routine on home equipment. What is needed is a mechanism for introducing competitive exercise elements into home workout routines.

DETAILED DESCRIPTION

Figure 1:
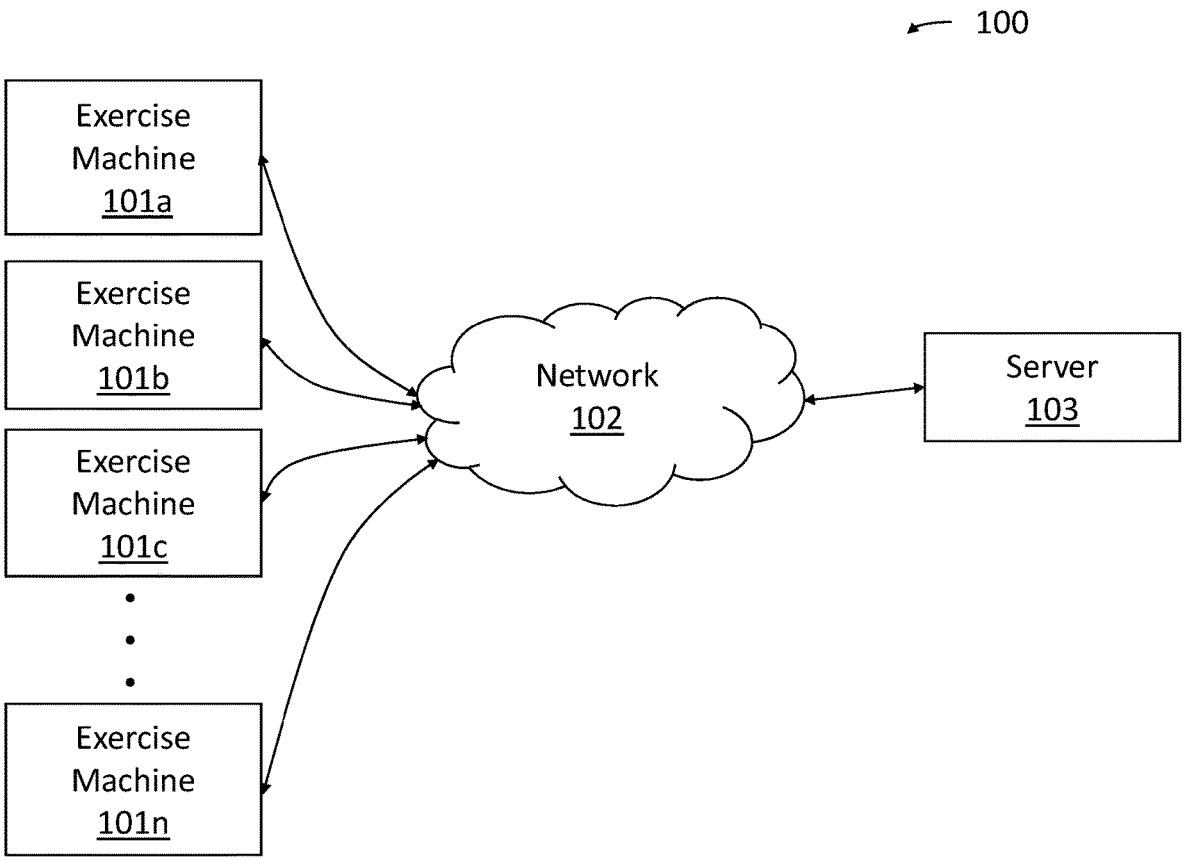
FIG. 1 is an example environment in accordance with one or more embodiments.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Comparing performance of users of exercise equipment using a leaderboard can be an effective tool for motivating the users of the exercise equipment to exercise more intensely and more frequently. However, dynamically comparing performance metrics for many tens, hundreds, or thousands of users is computationally expensive. Additionally, many users may not be motivated by a comparison of their performance to the performance of a large number of other users. The present disclosure solves these problems by intelligently selecting a subset of users performing a workout for comparison on a leaderboard. Dynamically comparing the performance metrics of the subset of users is computationally less expensive than dynamically comparing performance metrics of all users performing the workout. The subset of users may be selected based on similar attributes. A first user performing a workout may be compared to all users who are performing or who have performed the workout to determine a subset of all the users which are similar to the first user. A leaderboard may compare performance metrics of the first user to performance metrics of the similar users of the subset of all the users. This leaderboard comparison is less computationally expensive than a leaderboard comparison of performance metrics of all the users to the performance metrics of the first user, and the first user may be more motivated by this leaderboard comparison of the subset of users than by a leaderboard comparison of all the users. The first user may find it more meaningful to compete against a group of similar users than against a crowd of users, many of which are dissimilar to the user. Thus, the present disclosure solves the technical problem of computationally expensive leaderboard comparisons and the technical problem of providing a meaningful leaderboard comparison.

FIG. 1 is an example environment 100 in accordance with one or more embodiments. The environment 100 may include a first exercise machine 101*a*, a second exercise machine 101*b*, a third exercise machine 101*c*, and an nth exercise machine 101*n*, referred to collectively as exercise machines 101. The exercise machines 101 may communicate with a server 103 via a network 102. The network 102 may be any wide area network (WAN), local area network (LAN), or any other type of network. For example, the network 102 may be the Internet. The exercise machines 101 may include movable or moving members which are associated with exercise parameters such as incline, resistance, cadence, speed, distance, pace, power, calories, and time elapsed. The exercise machines 101 may be treadmills, exercise bikes, rowers, ellipticals, or other exercise devices. The exercise machines 101 may transmit exercise parameters determined during a workout to the server 103 via the network 102. The server 103 may host a workout program and transmit the workout program to the exercise machines 101. The server 103 may compare the exercise parameters determined during the workout and rank them. The server 103 may generate a leaderboard using the exercise parameters and transmit the leaderboard to the exercise machines 101 via the network 102. The exercise parameters may be transmitted asynchronously or simultaneously. A first user of the first exercise machine 101*a* may perform the workout program at a first time and a second user of the second exercise machine 101*b* may perform the workout program at a second time different from the first time. The server may compare exercise parameters of the first exercise machine collected during the workout program at the first time to exercise parameters of the second exercise machine collected during the workout program at the second time. The server 103 may generate a leaderboard based on the comparison of exercise parameters of the first exercise machine collected during the workout program at the first time to exercise parameters of the second exercise machine collected during the workout program at the second time. The server 103 may convert the exercise parameters into performance metrics for a user of each respective exercise machine. Each user of any of the exercise machines 101 may view a leaderboard generated for the workout program using exercise parameters of each other user of the exercise machines 101 who performed the workout program previously.

The server may generate simulated performance metrics for simulated users. In some embodiments, the simulated performance metrics may be based on simulated user parameters of the simulated users. In other embodiments, the simulated performance metrics may be based on aggregated performance metrics from multiple users. The server may include the simulated performance metrics and simulated users in comparing performance metrics of all users who performed the workout and in generating the leaderboard. The simulated users may be identified as simulated users on the leaderboard, or they may not be identified as simulated users. In some embodiments, the simulated users will be used in generating the leaderboard for all users participating in the workout program. In other embodiments, the simulated users will be used in generating the leaderboard for a subset of users participating in the workout program. Different simulated users may be generated for different subsets of users participating in the workout program. Each user may have a corresponding personal simulated user which is included in the leaderboard of each user. The personal simulated user may be based on user parameters, workout history, or other characteristics of the user. The user parameters may be received by a single user that has previously used the exercise device. In some embodiments, the user parameters may be received by multiple users that have previously used the exercise device. For example, the personal simulated user may be based on an aggregation of friends of the user and/or an aggregation of other users similar to the user.

Figure 2A:
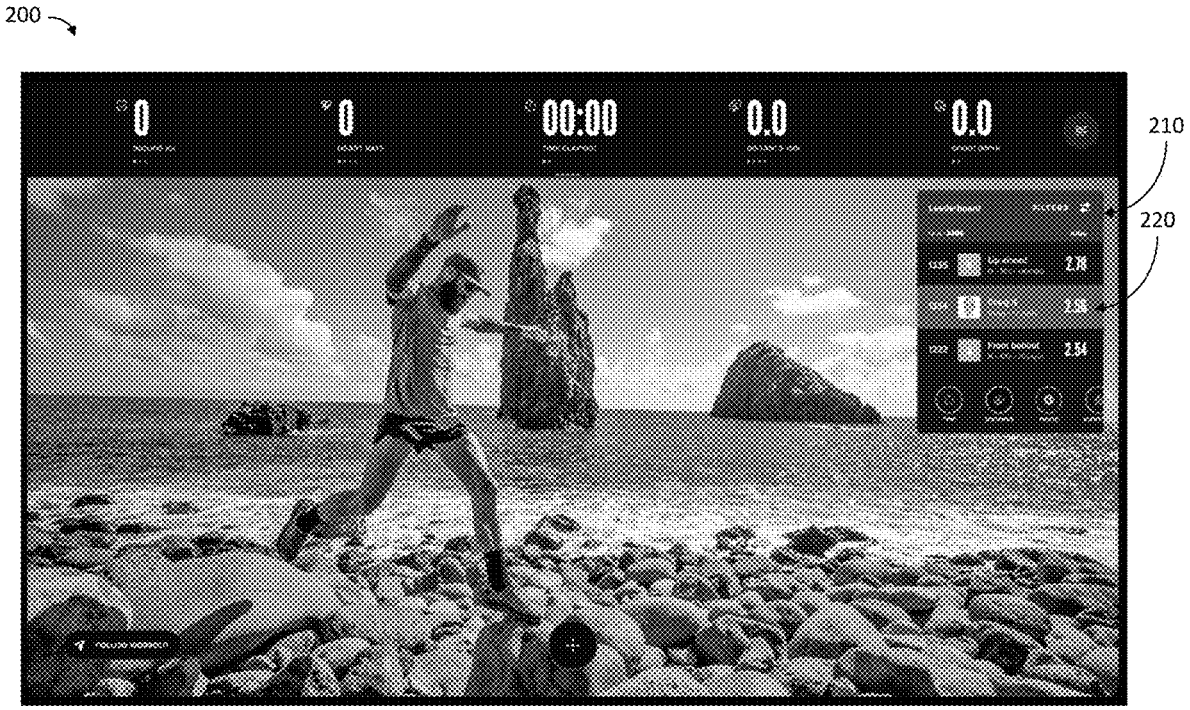
FIG. 2A is an example user interface including a leaderboard, in accordance with one or more embodiments.

FIG. 2A is an example user interface 200 including a leaderboard, in accordance with one or more embodiments. The user interface 200 may be a user interface 200 of an exercise machine 101*a* of FIG. 1. The user interface 200 may display (e.g., the computing device may cause to be displayed) user performance metrics including, but not limited to, incline, resistance, cadence, speed, heart rate, distance, pace, power, calories, time elapsed, and score. The performance metrics may be captured by an exercise device including a display for displaying the user interface 200. The user interface 200 may be used in conjunction with a workout program. The workout program may include video and audio of a trainer presenting the workout program. The user interface 200 may include a leaderboard 210. The leaderboard 210 may display (e.g., the computing device may cause to be displayed) a comparison of performance metrics of a plurality of users. A first user may use an exercise machine and generate performance metrics. The first user may view the user interface 200 including the performance metrics generated as the first user performs the workout program. The leaderboard 210 may include a first user indicator 220 including first user performance metrics. The leaderboard 210 may display a comparison of the first user performance metrics and performance metrics of a plurality of other users. The first user may view the leaderboard 210 on the user interface 200 as the first user performs the workout program.

Figure 2B:
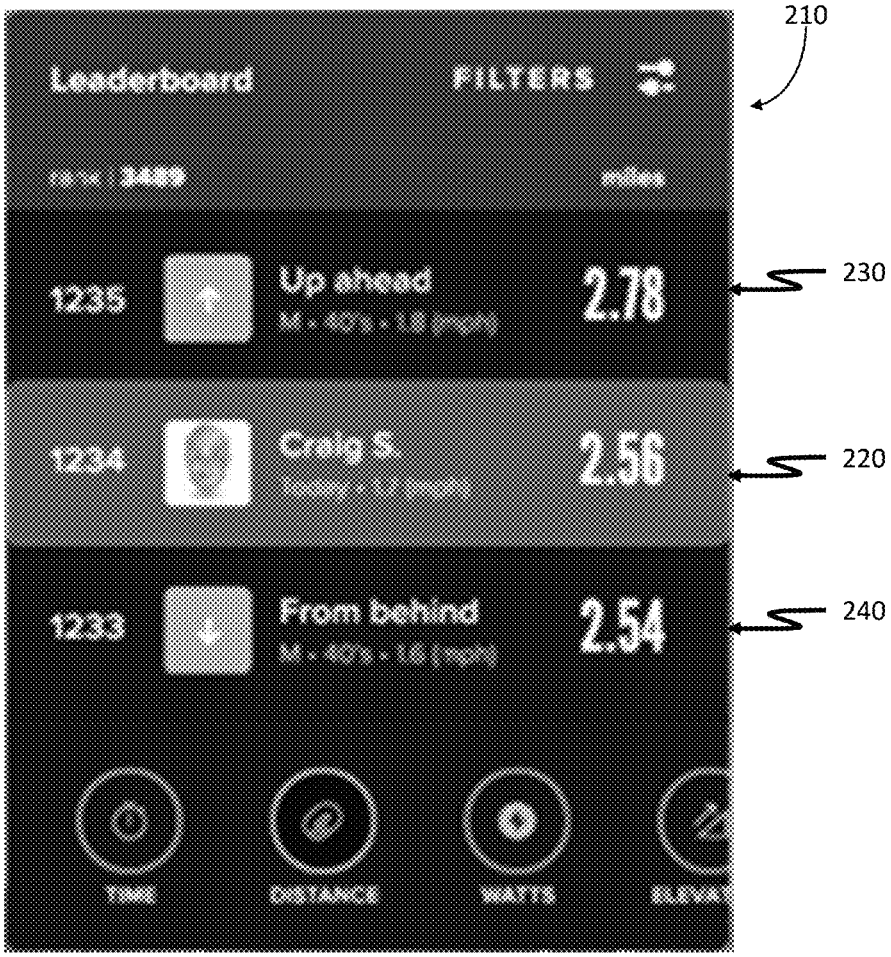
FIG. 2B is a detail of the leaderboard of FIG. 2A, in accordance with one or more embodiments.

FIG. 2B is a detail of the leaderboard 210 of FIG. 2A, in accordance with one or more embodiments. The leaderboard 210 may include the first user indicator 220, an up ahead user indicator 230, and a from behind user indicator 240. The first user indicator 220, the up ahead user indicator 230, and the from behind user indicator 240 may all display the same performance metrics of different users. For example, the indicators 220, 230, 240 may display a rank, a visual indicator, a speed, and a distance. The up ahead user indicator 230 may display performance metrics of a user ranked just above the first user and the from behind user indicator 240 may display performance metrics of a user just behind the first user. The up ahead user indicator 230 and the from behind user indicator 240 may or may not display user information of their respective users.

The leaderboard 210 may include indicators of performance metrics such as time, distance, watts, and elevation. The indicators may be interactive and, when selected, may cause the leaderboard 210 to display the selected performance metric in each of the user indicators 220, 230, 240. The leaderboard 210 may include an indication of which performance metric is currently displayed. The leaderboard 210 shows, for example, miles. The leaderboard may include a rank total, indicating a total number of users in the leaderboard.

Figure 3:
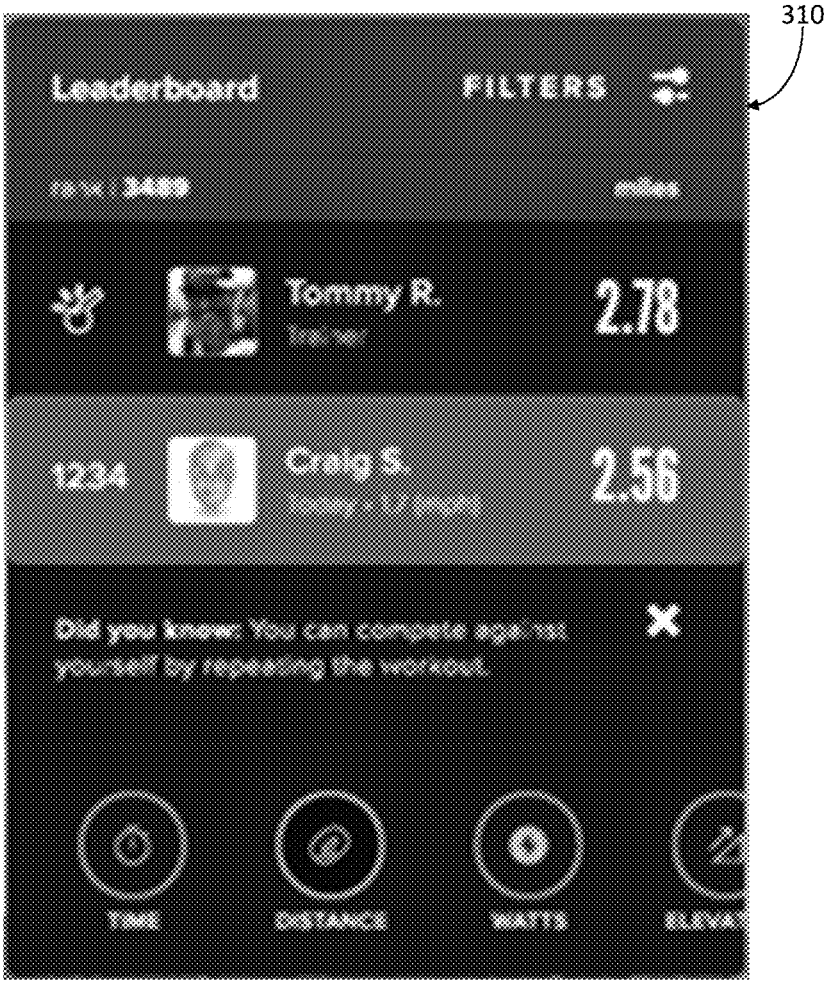
FIG. 3 is an example leaderboard, in accordance with one or more embodiments.

FIG. 3 is an example leaderboard 310, in accordance with one or more embodiments. The leaderboard 310 may replace the leaderboard 210 in the user interface 200 of FIG. 2A. The leaderboard 310 may compare the first user's performance metrics to trainer performance metrics. The trainer performance metrics may correspond to the video of the trainer in the workout program. The leaderboard 310 may also display (e.g., the computing device may cause the leaderboard 310 to display) a rank of the first user based on comparing the first user's performance metrics to performance metrics of all users who have performed the workout routine.

Figure 4:
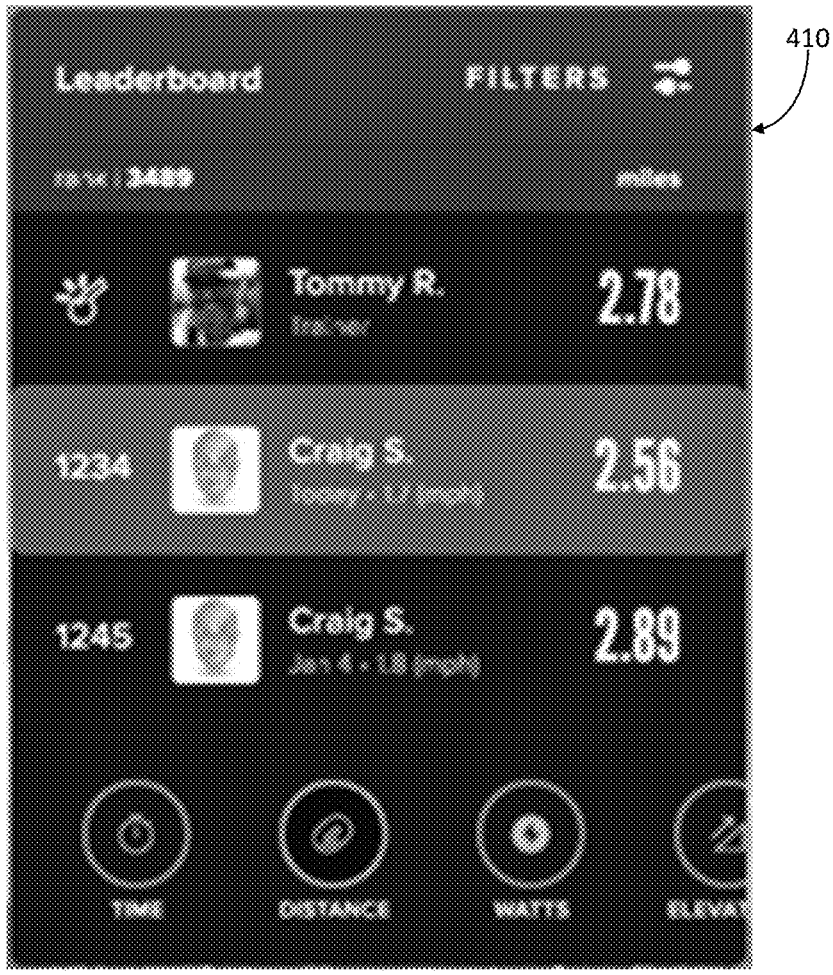
FIG. 4 is another example leaderboard, in accordance with one or more embodiments.

FIG. 4 is another example leaderboard 410, in accordance with one or more embodiments. The leaderboard 410 may replace the leaderboard 210 in the user interface 200 of FIG. 2A. The leaderboard 410 may compare the first user's current performance metrics to trainer performance metrics and performance metrics of one or more past instances of the first user performing the workout. The first user can compete against their past performance, with the trainer performance metrics as a benchmark. Indicators of the one or more past instances of the first user performing the workout may display the date on which the performance metrics were captured.

Figure 5:
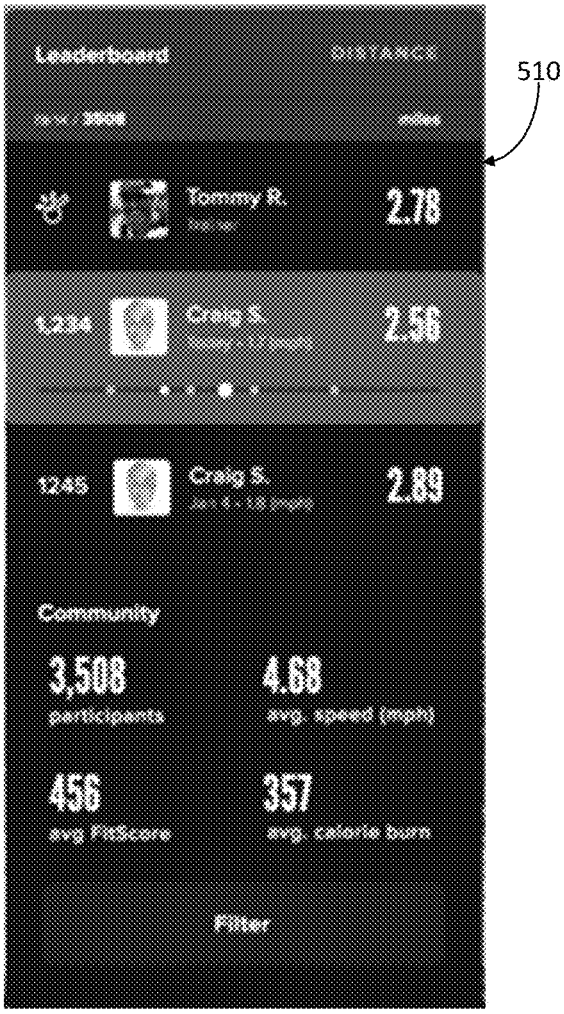
FIG. 5 is yet another example leaderboard, in accordance with one or more embodiments.

FIG. 5 is yet another example leaderboard 510, in accordance with one or more embodiments. The leaderboard 510 may replace the leaderboard 210 in the user interface 200 of FIG. 2A. The leaderboard 510 may compare the first user's current performance metrics to trainer performance metrics and performance metrics of one or more past instances of the first user performing the workout. The leaderboard 510 may also include a linear indicator comparing the first user's performance metrics to performance metrics of users of similar rank to the first user. Icons on the linear indicator may represent other users who are currently executing or who have previously executed the workout program. The position of the icons may correspond to performance metrics. The relative position of the icons may indicate relative achievement along the performance metric currently displayed. The first user may be able to see how their performance metrics compare to performance metrics of other riders of similar rank. For example, when the performance metric current display is distance, the first user can see how close their distance metric is to the distance metrics of other users at a current time as the first user executes the workout program, and how a change in the first user's distance metric over time compares to a change in the previous users' distance metric over time.

In some embodiments, the linear indicator may include icons representing all other users who are currently executing or who have executed the workout program. In other embodiments, the linear indicator may include icons representing other users who are similar to the first user. The other users who are similar to the first user may be selected as discussed herein.

Figure 6:
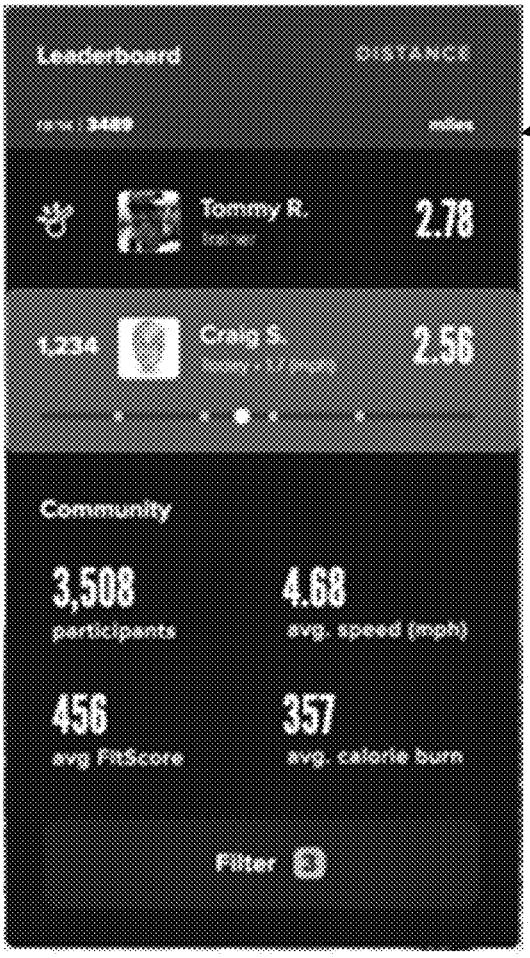
FIG. 6 is yet another example leaderboard, in accordance with one or more embodiments.

FIG. 6 is yet another example leaderboard, in accordance with one or more embodiments. The leaderboard 610 may replace the leaderboard 210 in the user interface 200 of FIG. 2A. The leaderboard 610 may compare the first user's current performance metrics to trainer performance metrics and performance metrics of one or more past instances of the first user performing the workout as in FIG. 4. The leaderboard 610 may include the linear indicator of FIG. 5. The leaderboard 610 may include community statistics. The community statistics may include a number of participants as well as average performance metrics. The community statistics may depend upon one or more filters applied by the first user. Filters may be based on age, sex, location, athletic ability, and other user parameters. For example, the user may filter other users by age to include only other users older than thirty. The linear indicator will then only include icons corresponding to the other users over thirty and the community statistics will include a number of the other users over thirty and average performance metrics of the other users over thirty. The first user may apply multiple filters. For example, the first user may apply filters to only see performance metrics corresponding to other users who are male and over thirty.

Figure 7:
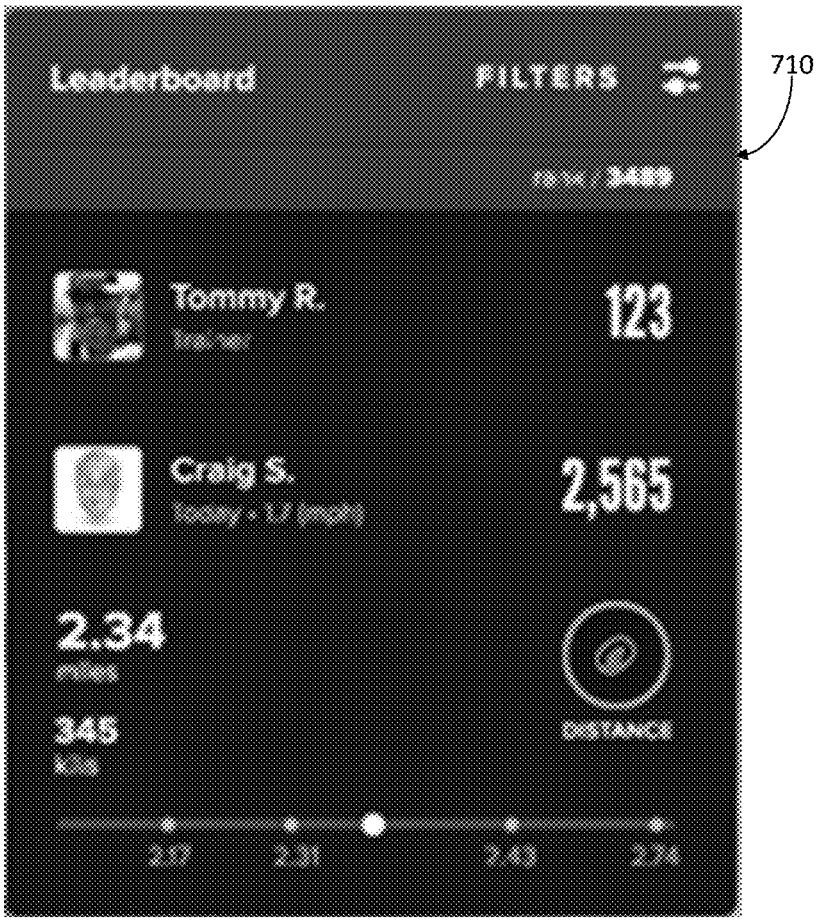
FIG. 7 is yet another example leaderboard, in accordance with one or more embodiments.

FIG. 7 is yet another example leaderboard 710, in accordance with one or more embodiments. The leaderboard 710 may replace the leaderboard 210 in the user interface 200 of FIG. 2A. The leaderboard 710 may compare the first user's current performance metrics to trainer performance metrics and performance metrics of one or more past instances of the first user performing the workout as in FIG. 4. The leaderboard 710 may include a linear indicator as in FIG. 5, but with the additional detail of number values associated with the icons representing the performance metrics of other users who are currently executing, or who have executed, the workout program. The number values may indicate the value of the performance metrics of the other users at a time in the workout program corresponding to a current time as the first user executes the workout program.

Figure 8:
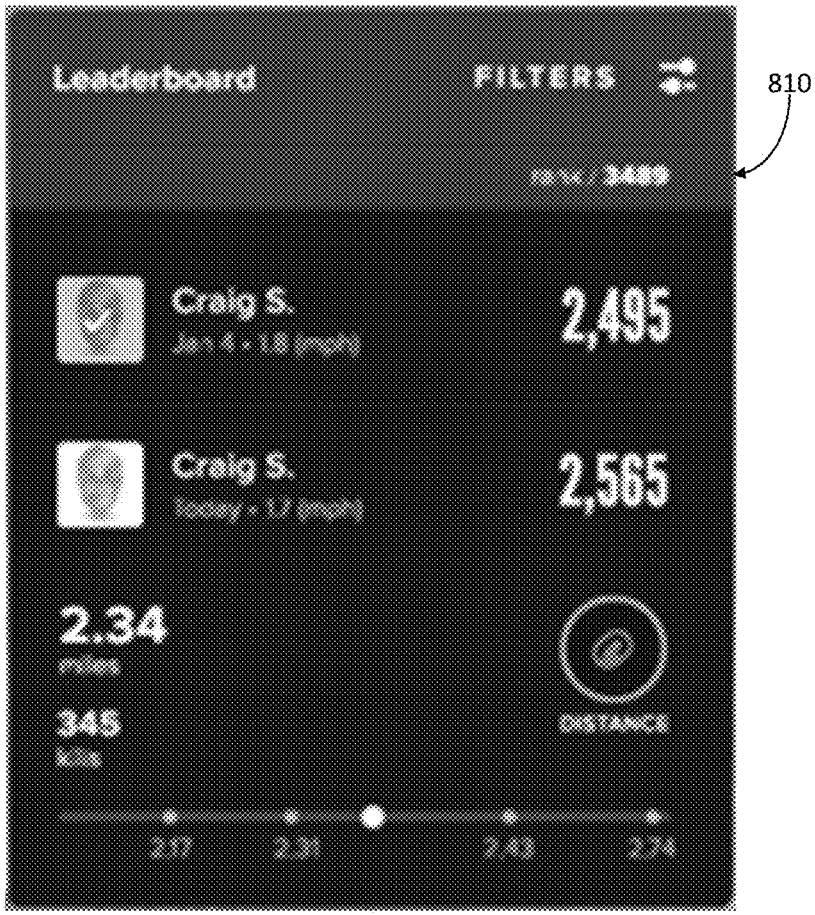
FIG. 8 is yet another example leaderboard, in accordance with one or more embodiments.
Figure 9:
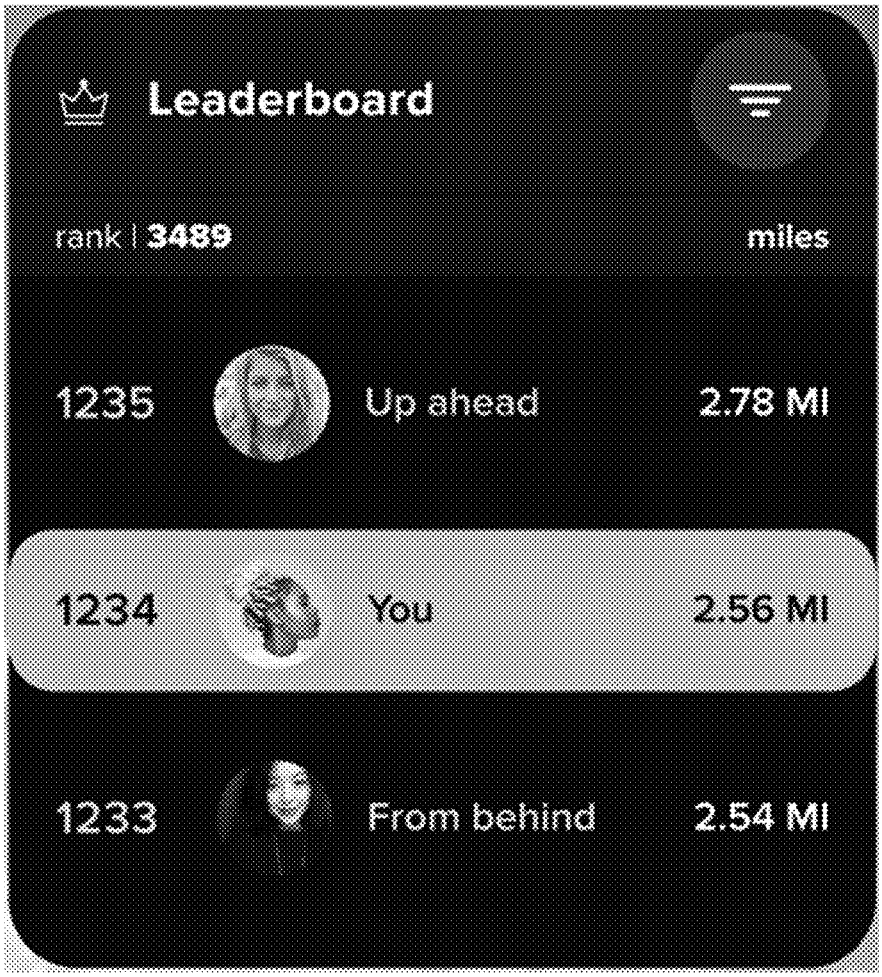
FIG. 9 is yet another example leaderboard, in accordance with one or more embodiments.
Figure 10:
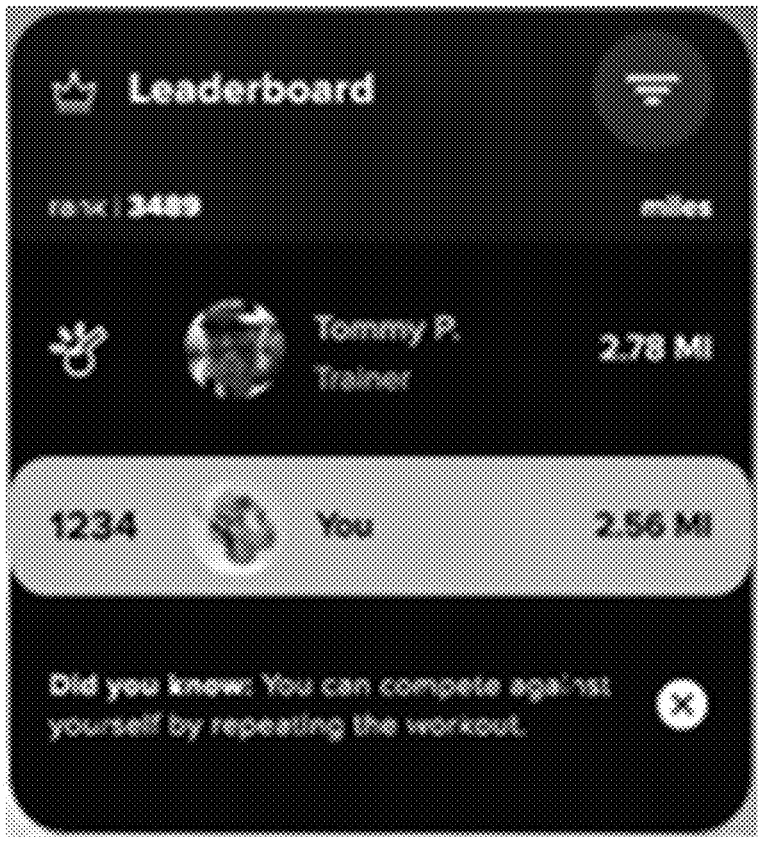
FIG. 10 is yet another example leaderboard, in accordance with one or more embodiments.
Figure 11:
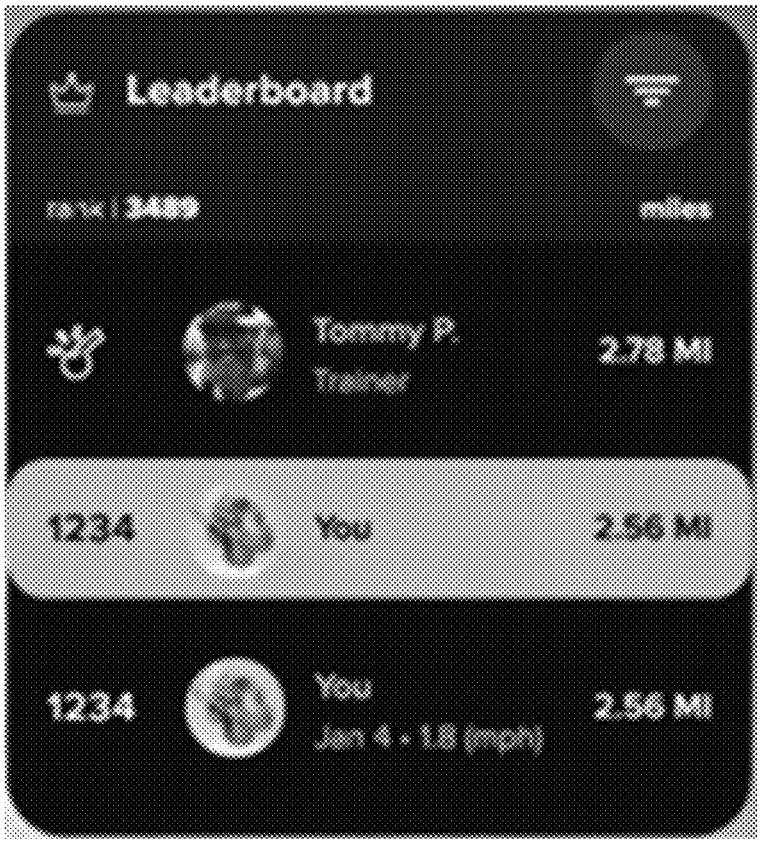
FIG. 11 is yet another example leaderboard, in accordance with one or more embodiments.
Figure 12:
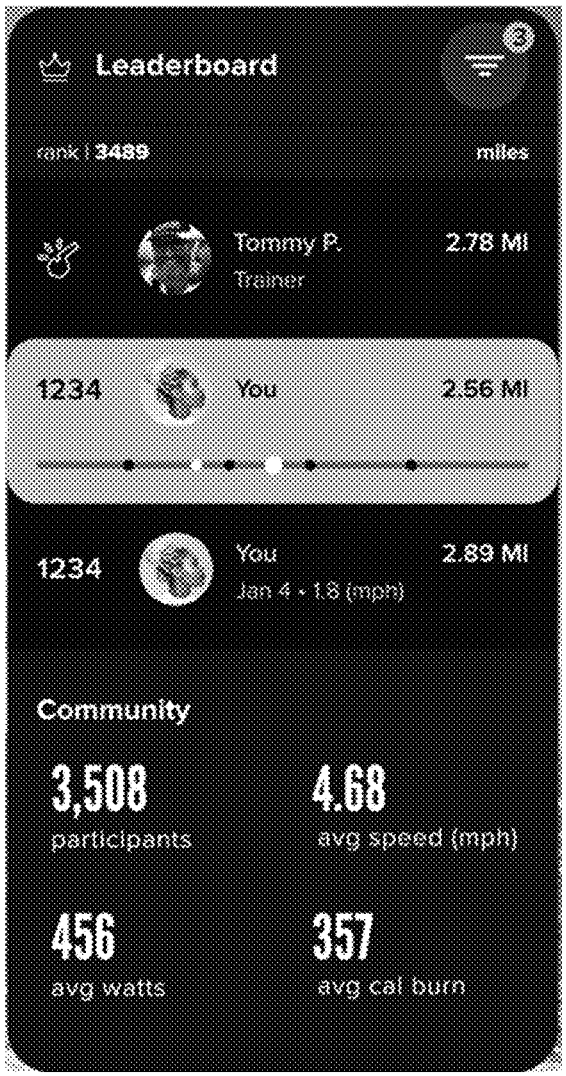
FIG. 12 is yet another example leaderboard, in accordance with one or more embodiments.
Figure 13:
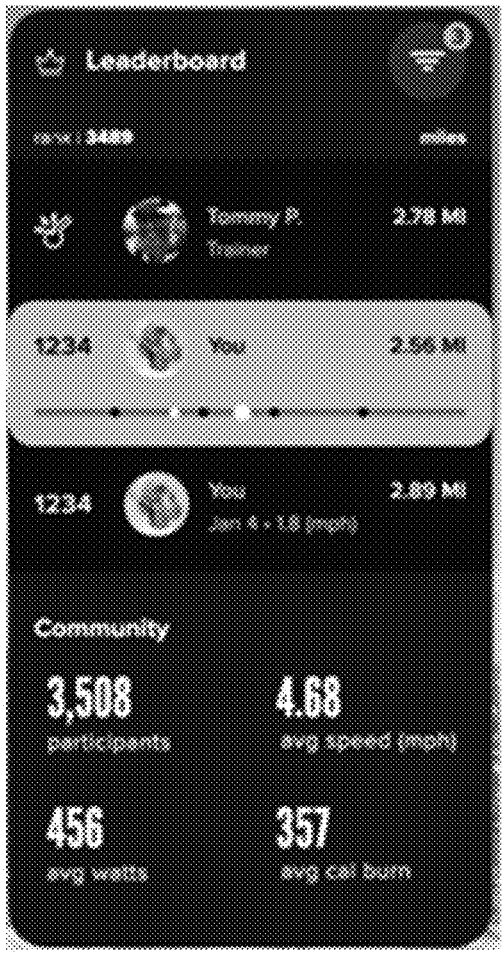
FIG. 13 is yet another example leaderboard, in accordance with one or more embodiments.
Figure 14:
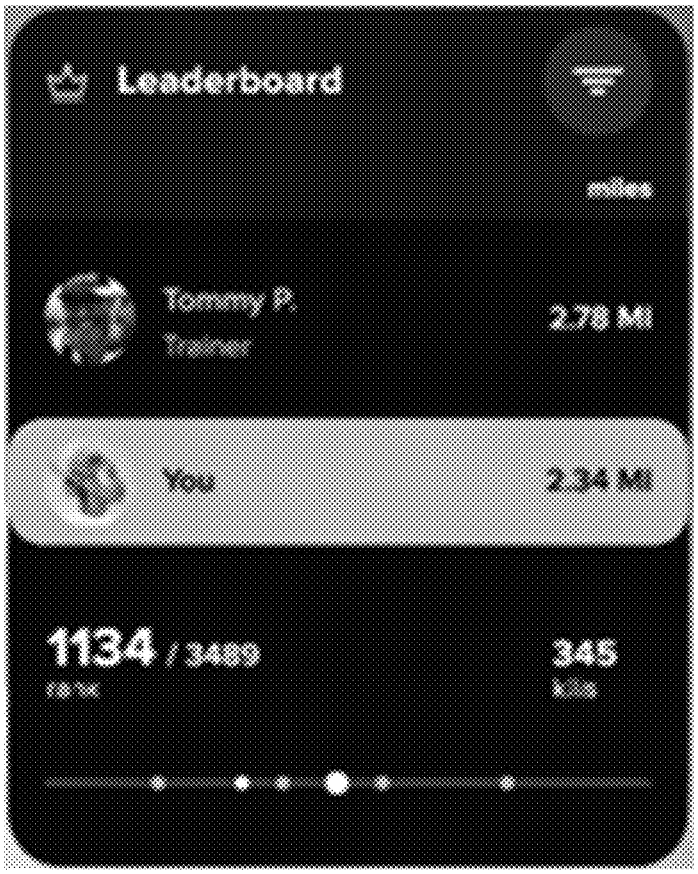
FIG. 14 is yet another example leaderboard, in accordance with one or more embodiments.
Figure 15:
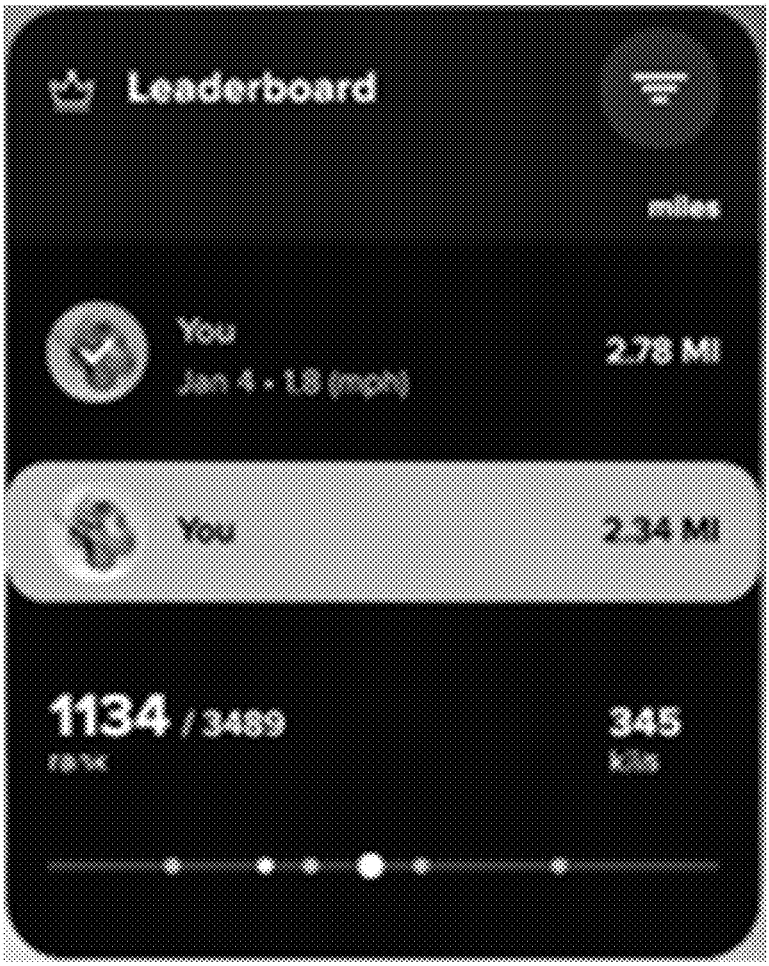
FIG. 15 is yet another example leaderboard, in accordance with one or more embodiments.
Figure 16:
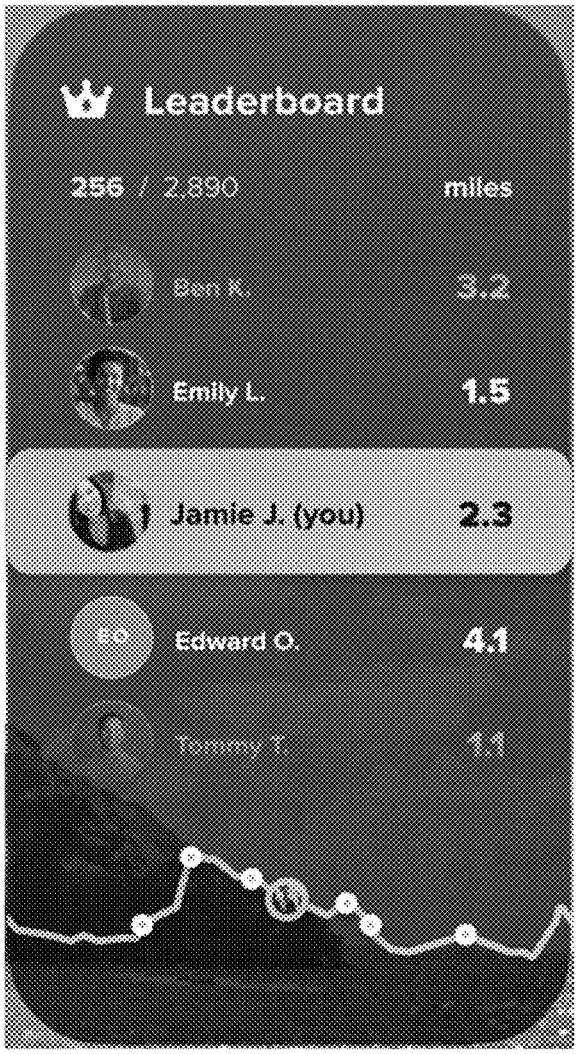
FIG. 16 is yet another example leaderboard, in accordance with one or more embodiments.

FIG. 8 is yet another example leaderboard, in accordance with one or more embodiments. The leaderboard 810 may replace the leaderboard 210 in the user interface 200 of FIG. 2A. The leaderboard 810 may compare the first user's current performance metrics to performance metrics of one or more past instances of the first user performing the workout. For example, the leaderboard 810 may compare a rank of the first user to a rank of a past instance of the first user performing the workout. The leaderboard 810 may include the linear indicator of FIG. 7.

FIGS. 9-15 are additional example leaderboards, in accordance with one or more embodiments.

Figure 17:
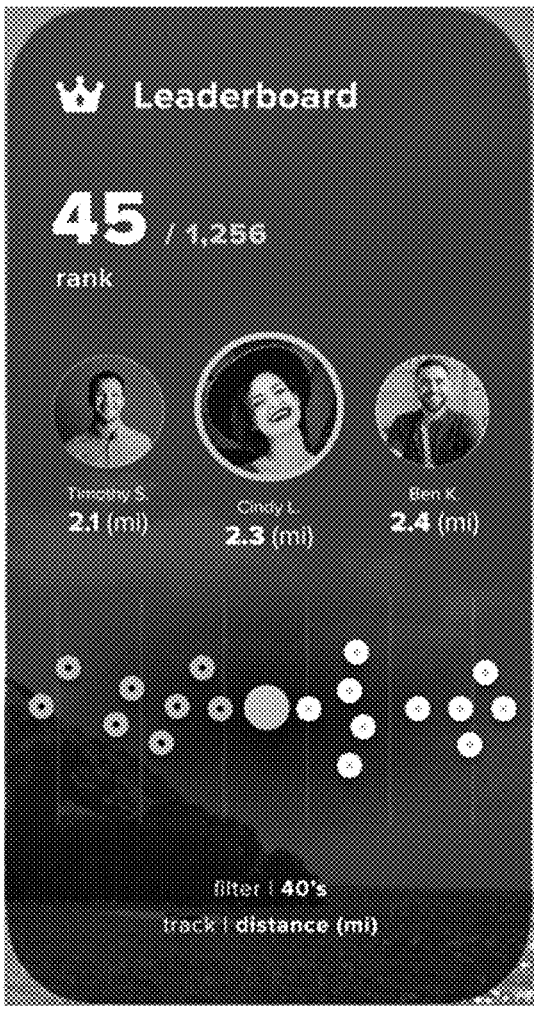
FIG. 17 is yet another example leaderboard, in accordance with one or more embodiments.

FIG. 17 is yet another example leaderboard, in accordance with one or more embodiments.

Figure 18:
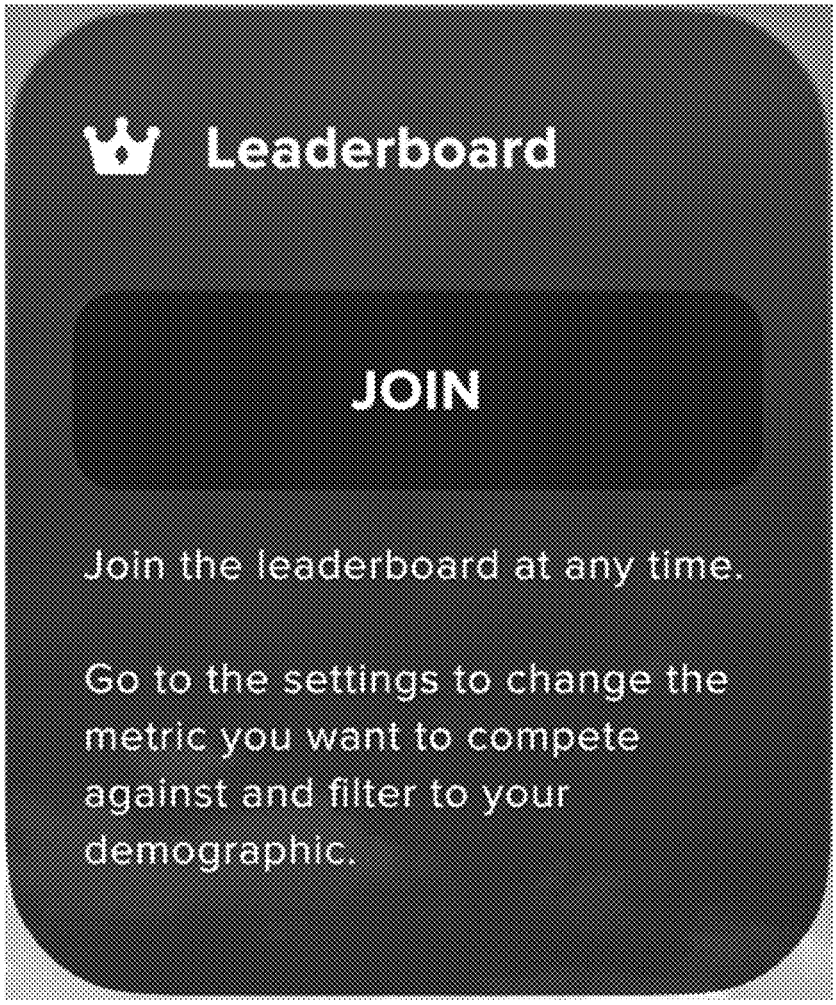
FIG. 18 is yet another example leaderboard, in accordance with one or more embodiments.

FIG. 18 is yet another example leaderboard, in accordance with one or more embodiments.

Figure 19:
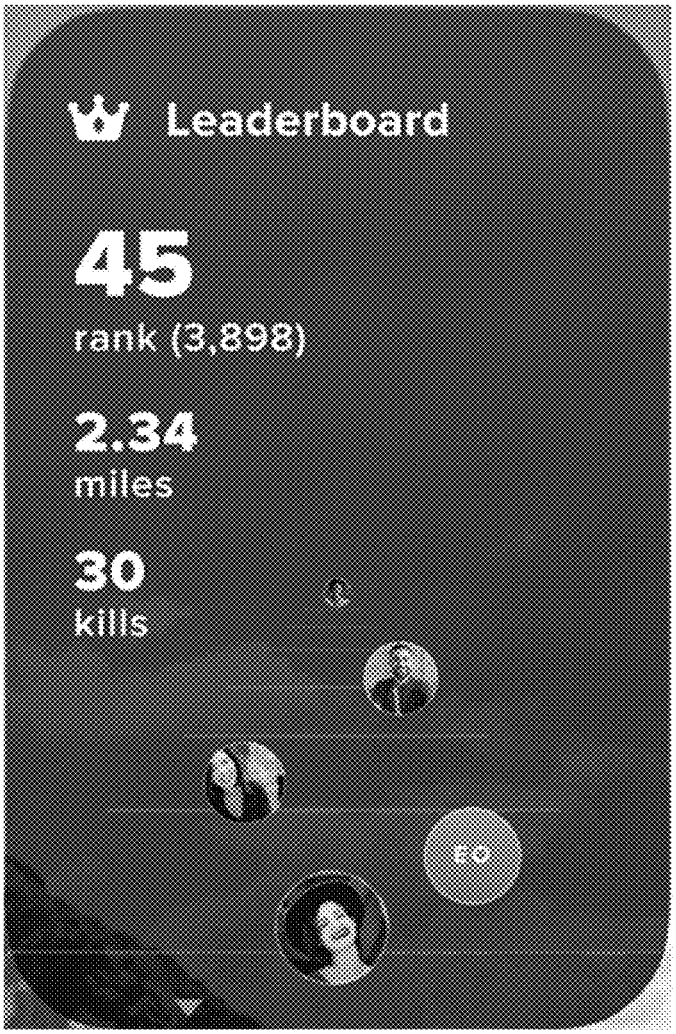
FIG. 19 is yet another example leaderboard, in accordance with one or more embodiments.

FIG. 19 is yet another example leaderboard, in accordance with one or more embodiments.

Figure 20:
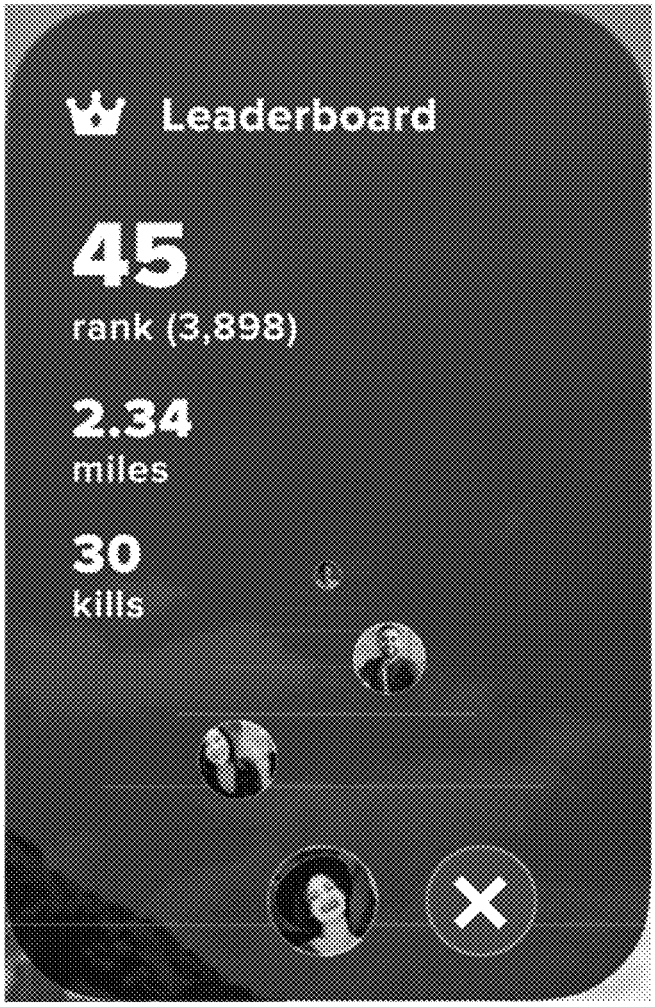
FIG. 20 is yet another example leaderboard, in accordance with one or more embodiments.

FIG. 20 is yet another example leaderboard, in accordance with one or more embodiments.

Figure 21:
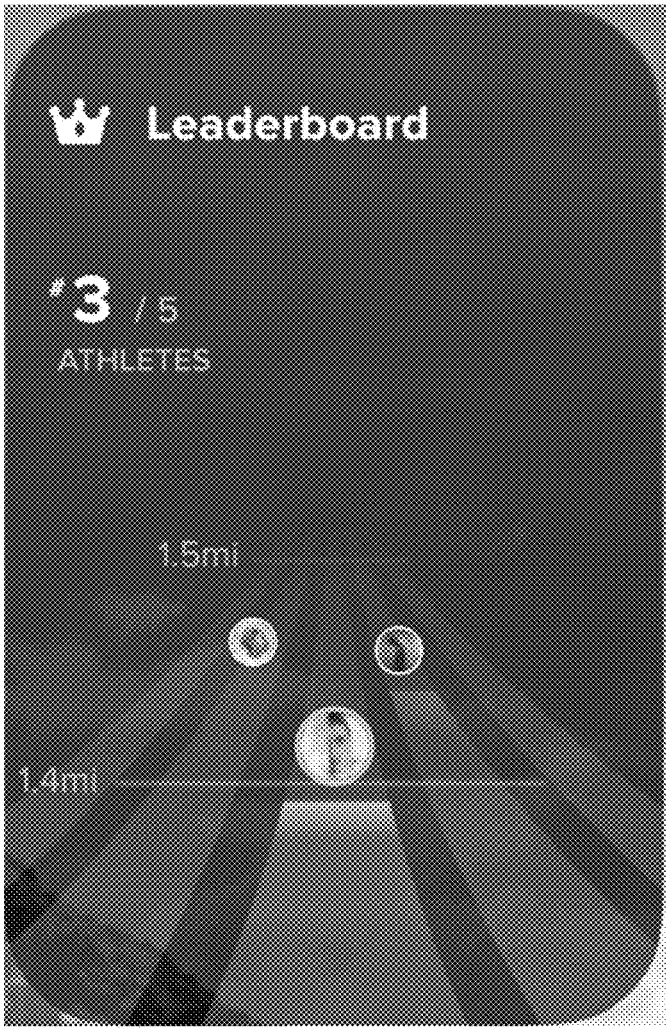
FIG. 21 is yet another example leaderboard, in accordance with one or more embodiments.

FIG. 21 is yet another example leaderboard, in accordance with one or more embodiments.

Figure 22:
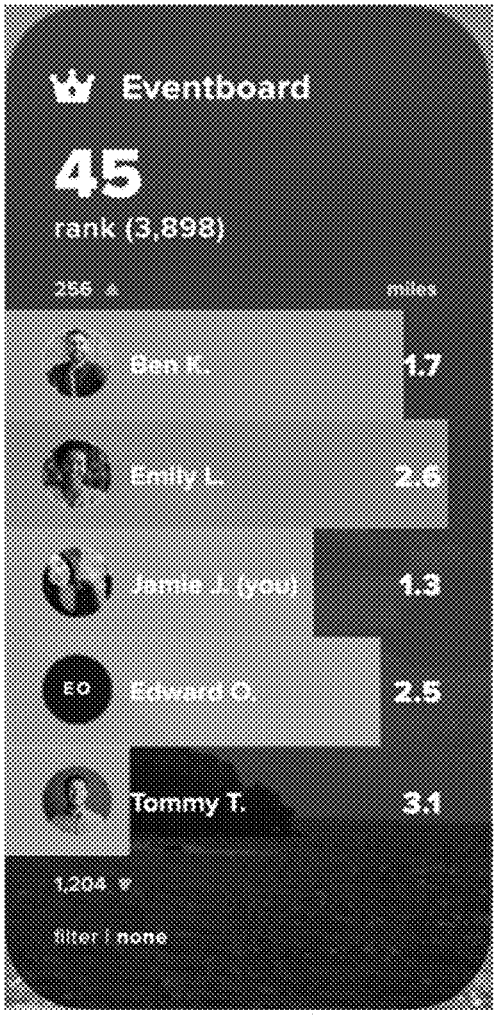
FIG. 22 is yet another example leaderboard, in accordance with one or more embodiments.

FIG. 22 is yet another example leaderboard, in accordance with one or more embodiments.

Figure 23:
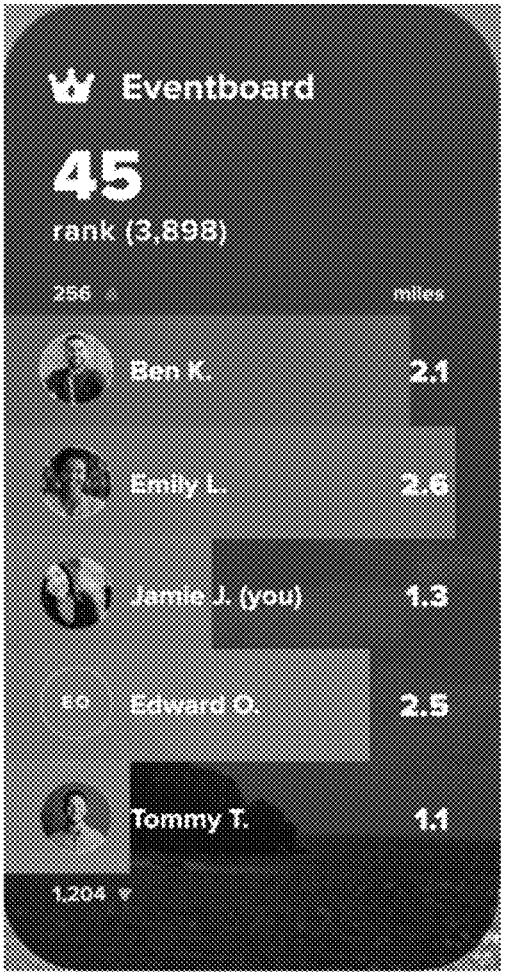
FIG. 23 is yet another example leaderboard, in accordance with one or more embodiments.

FIG. 23 is yet another example leaderboard, in accordance with one or more embodiments.

Figure 24:
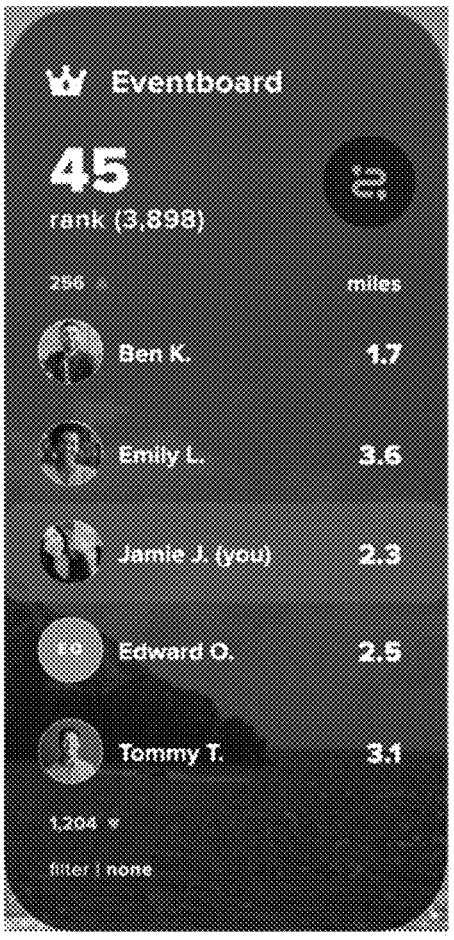
FIG. 24 is yet another example leaderboard, in accordance with one or more embodiments.

FIG. 24 is yet another example leaderboard, in accordance with one or more embodiments.

Figure 25:
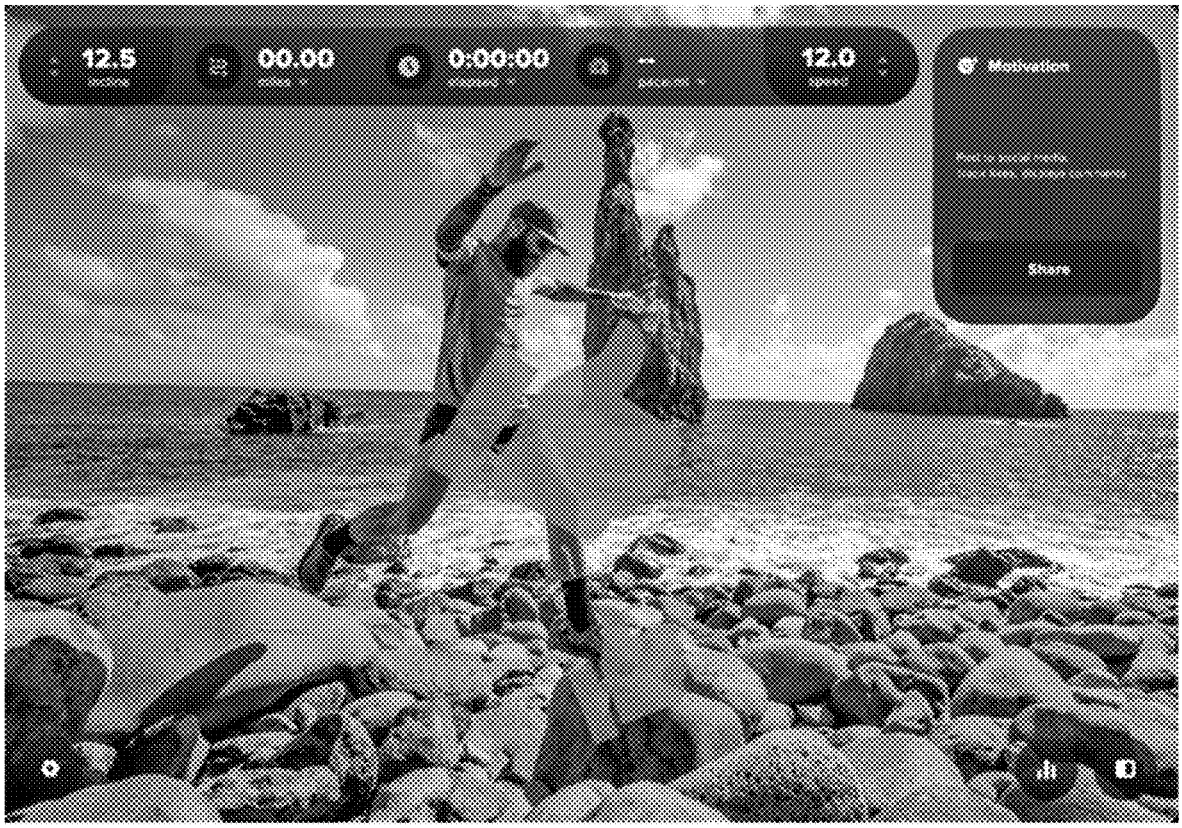
FIG. 25 is yet another example leaderboard, in accordance with one or more embodiments.

FIG. 25 is yet another example leaderboard, in accordance with one or more embodiments.

Figure 26:
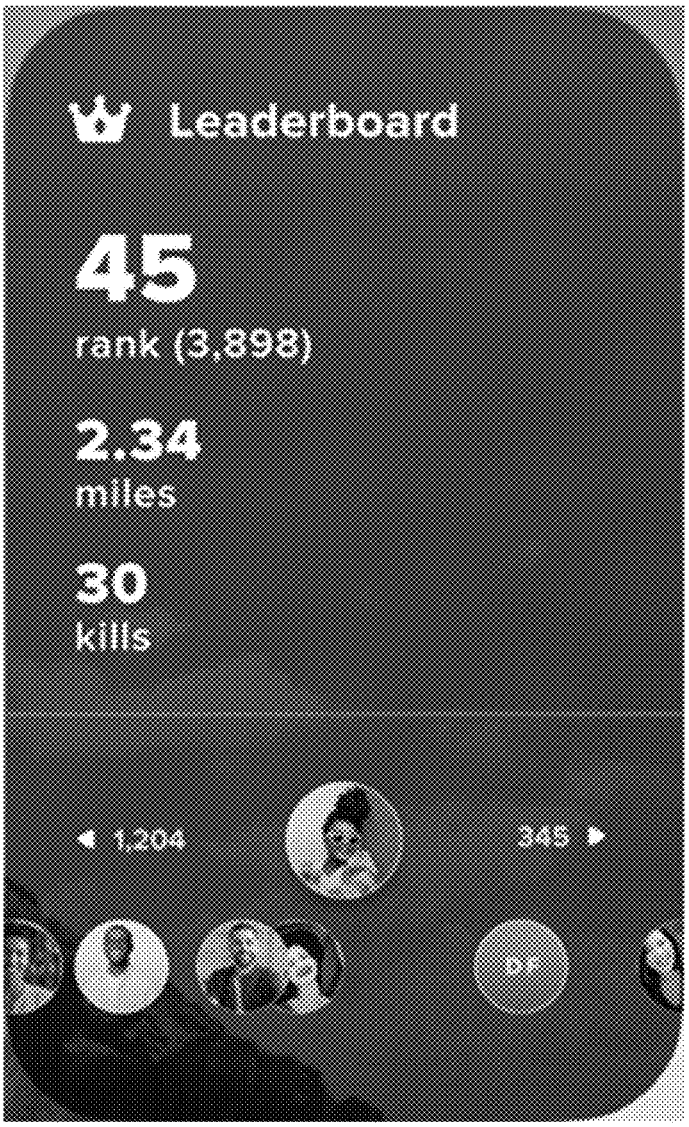
FIG. 26 is yet another example leaderboard, in accordance with one or more embodiments.

FIG. 26 is yet another example leaderboard, in accordance with one or more embodiments.

Figure 27:
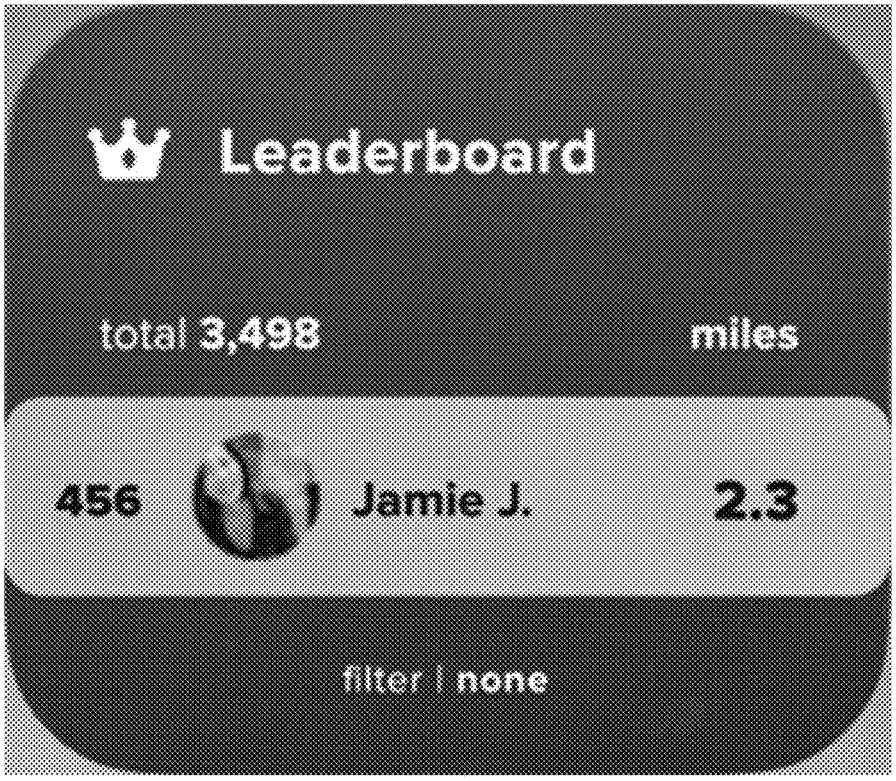
FIG. 27 is yet another example leaderboard, in accordance with one or more embodiments.

FIG. 27 is yet another example leaderboard, in accordance with one or more embodiments.

Figure 28:
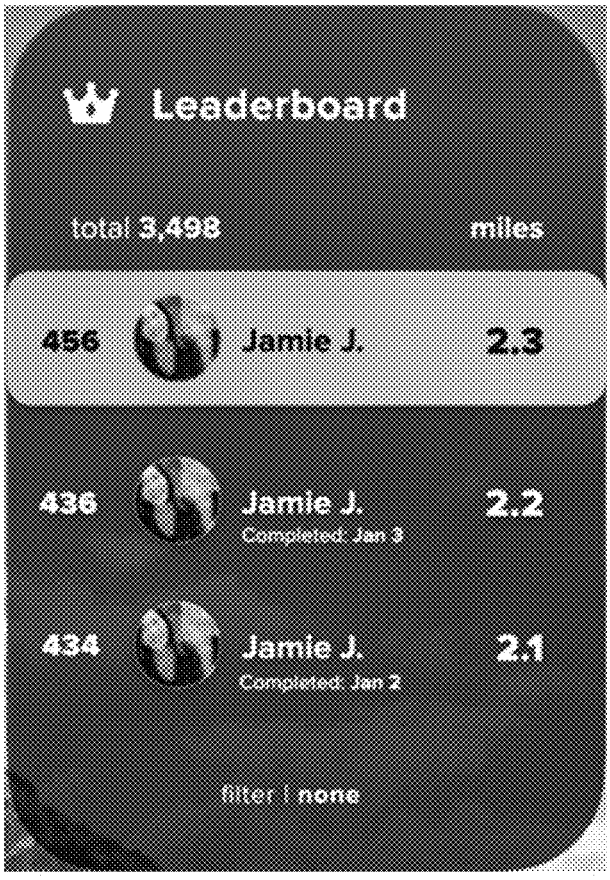
FIG. 28 is yet another example leaderboard, in accordance with one or more embodiments.

FIG. 28 is yet another example leaderboard, in accordance with one or more embodiments.

Figure 29:
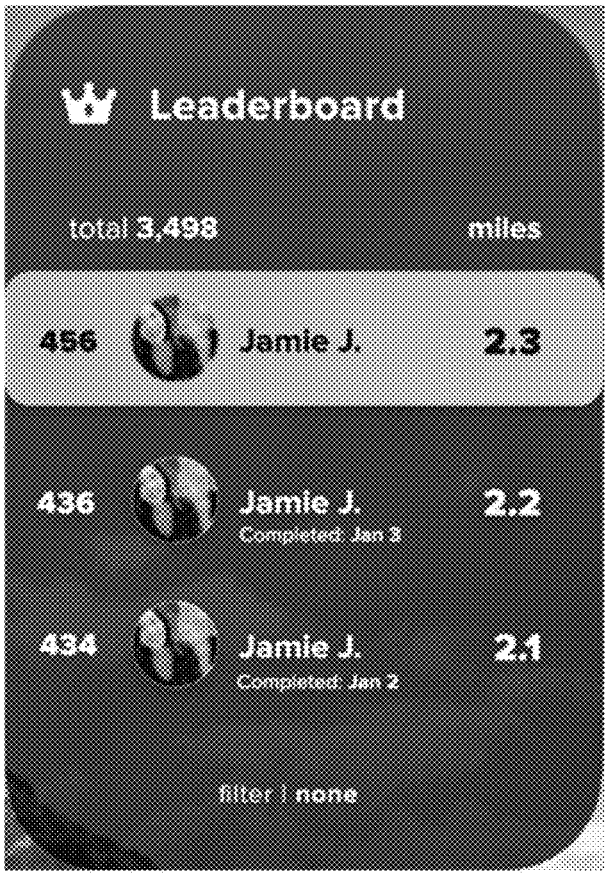
FIG. 29 is yet another example leaderboard, in accordance with one or more embodiments.

FIG. 29 is yet another example leaderboard, in accordance with one or more embodiments.

Figure 30:
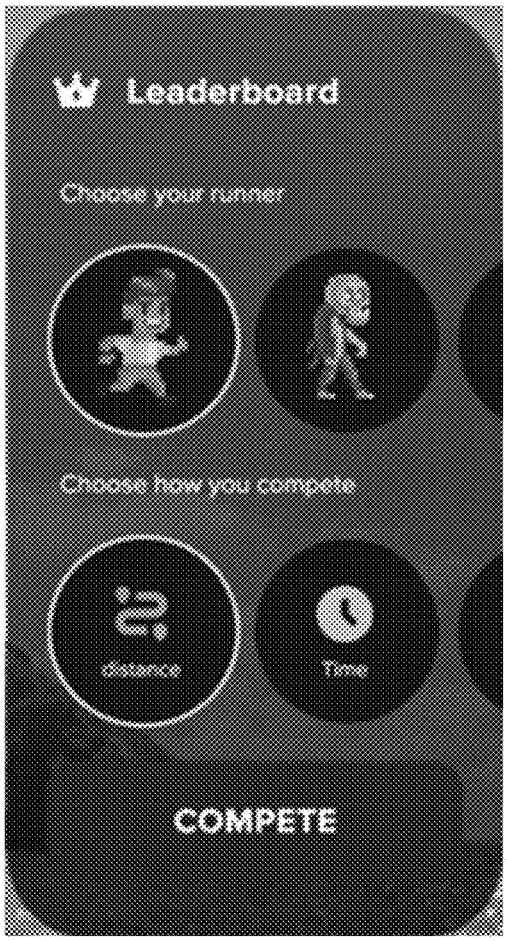
FIG. 30 is yet another example leaderboard, in accordance with one or more embodiments.

FIG. 30 is yet another example leaderboard, in accordance with one or more embodiments.

Figure 31:
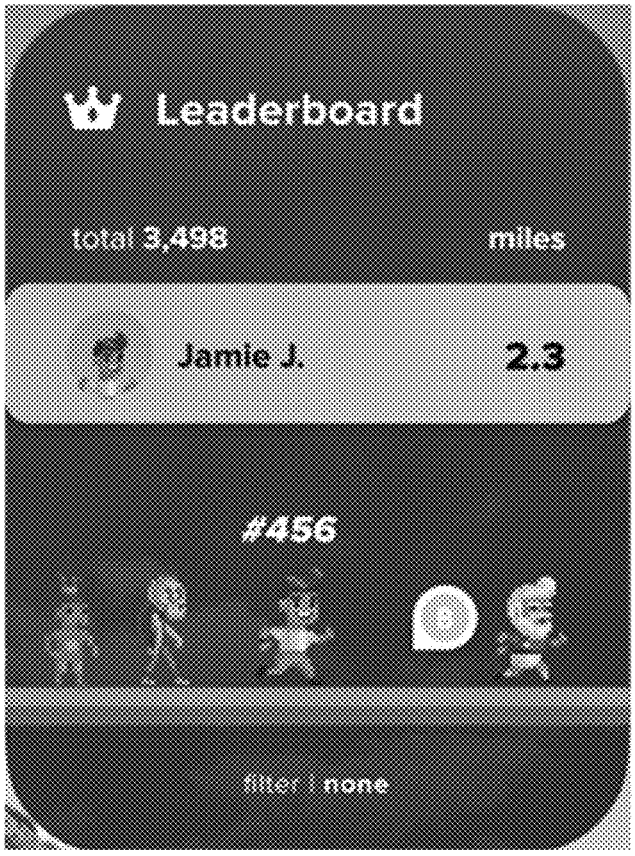
FIG. 31 is yet another example leaderboard, in accordance with one or more embodiments.

FIG. 31 is yet another example leaderboard, in accordance with one or more embodiments.

Figure 32:
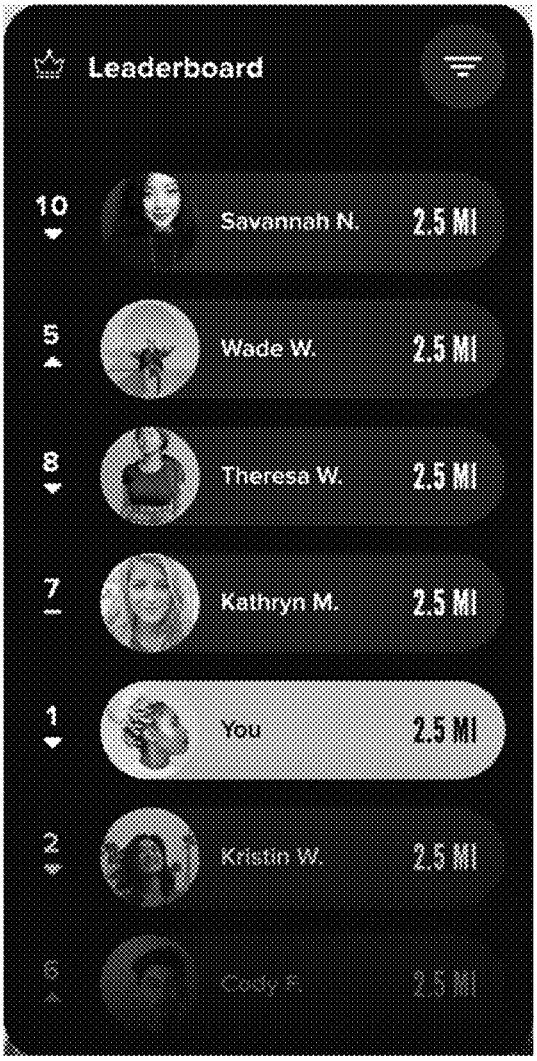
FIG. 32 is yet another example leaderboard, in accordance with one or more embodiments.

FIG. 32 is yet another example leaderboard, in accordance with one or more embodiments.

Figure 33:
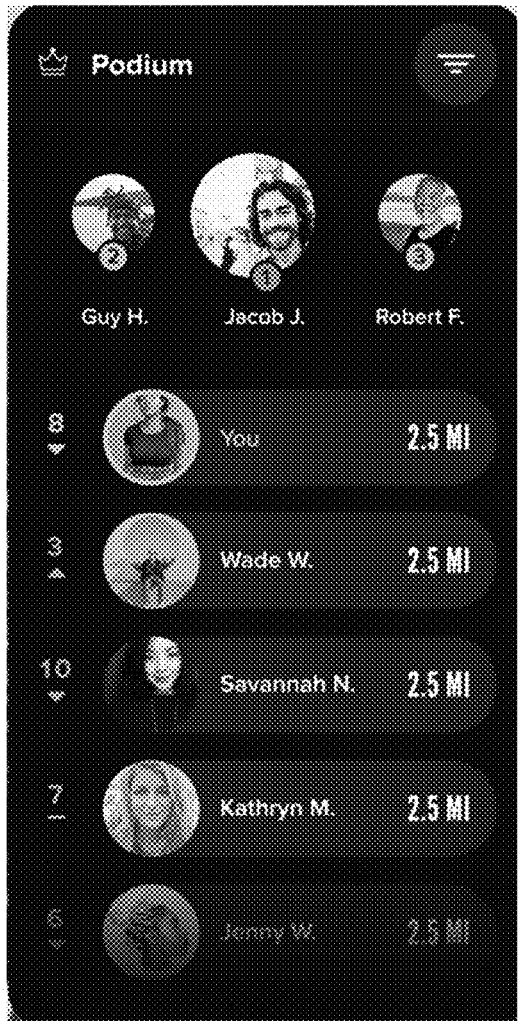
FIG. 33 is yet another example leaderboard, in accordance with one or more embodiments.

FIG. 33 is yet another example leaderboard, in accordance with one or more embodiments.

Figure 34:
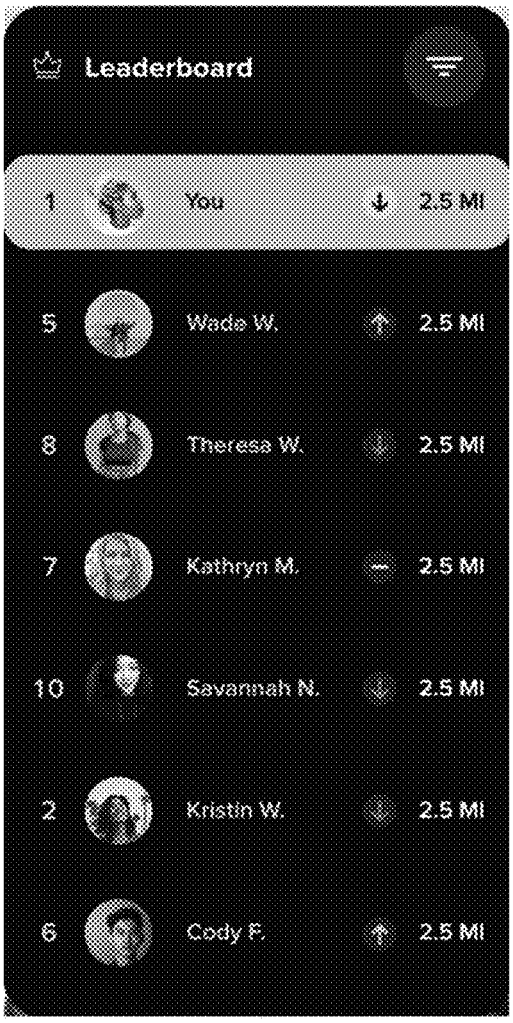
FIG. 34 is yet another example leaderboard, in accordance with one or more embodiments.

FIG. 34 is yet another example leaderboard, in accordance with one or more embodiments.

Figure 35:
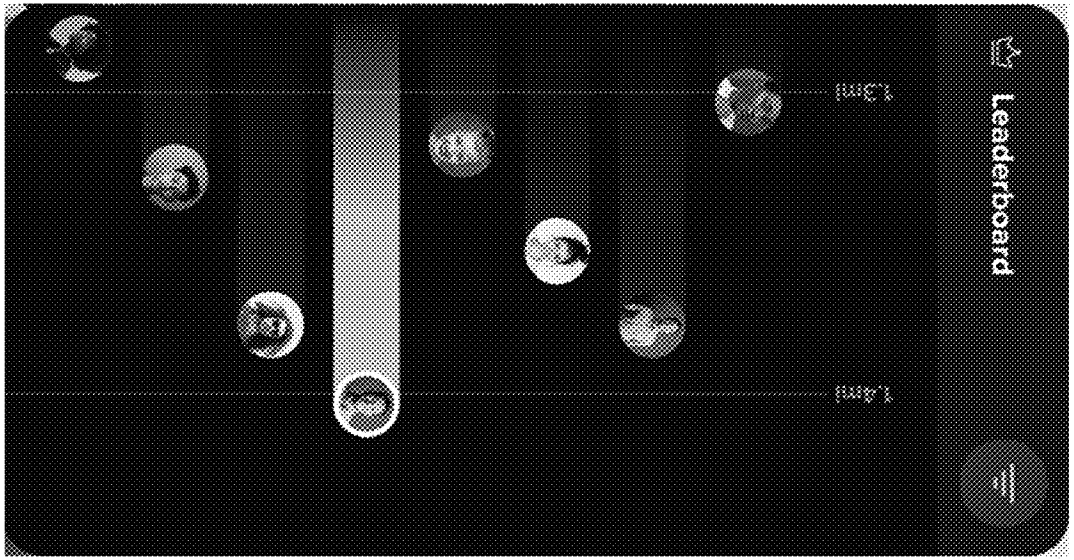
FIG. 35 is yet another example leaderboard, in accordance with one or more embodiments.

FIG. 35 is yet another example leaderboard, in accordance with one or more embodiments.

Figure 36:
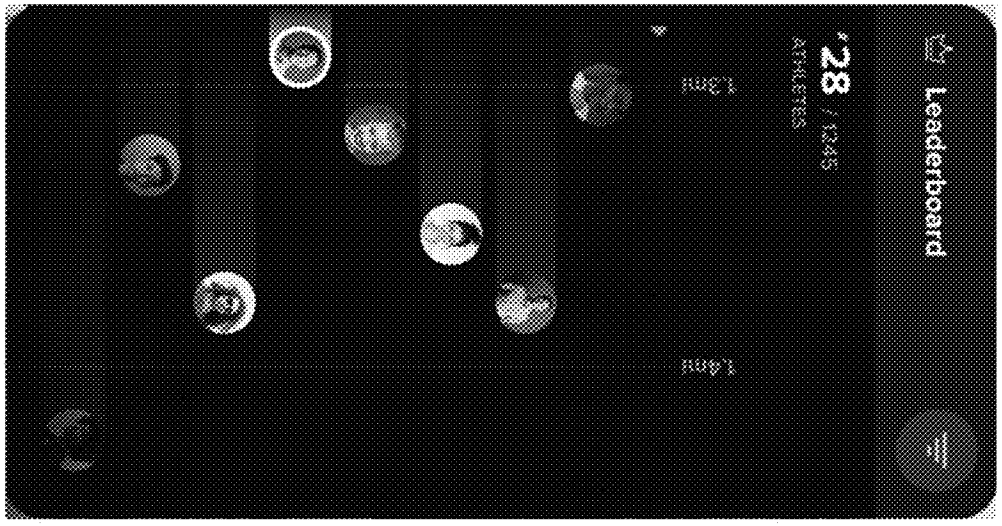
FIG. 36 is yet another example leaderboard, in accordance with one or more embodiments.

FIG. 36 is yet another example leaderboard, in accordance with one or more embodiments.

Figure 37:
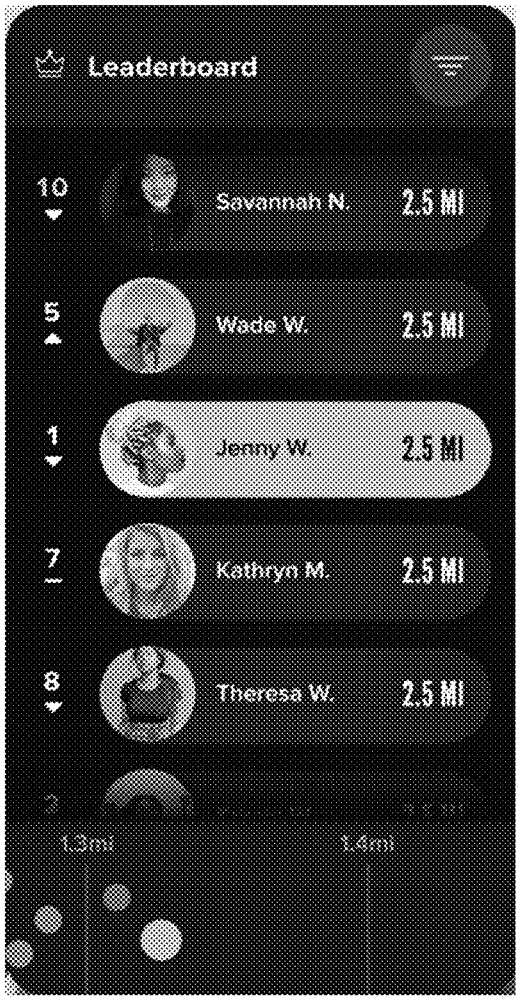
FIG. 37 is yet another example leaderboard, in accordance with one or more embodiments.

FIG. 37 is yet another example leaderboard, in accordance with one or more embodiments.

Figure 38:
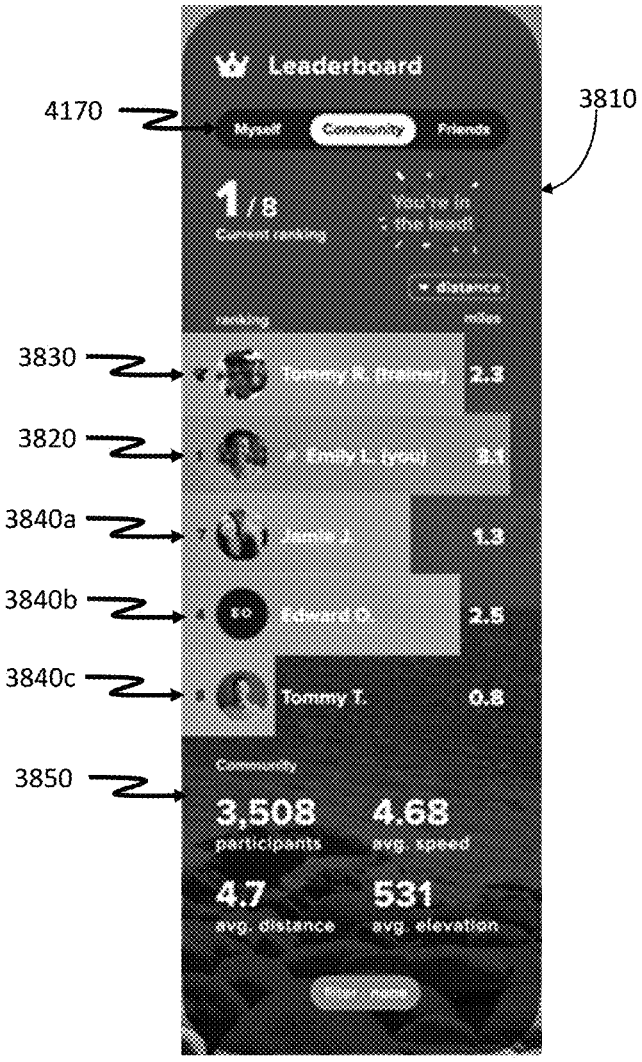
FIG. 38 is yet another example leaderboard, in accordance with one or more embodiments.

FIG. 38 is yet another example leaderboard, in accordance with one or more embodiments. The leaderboard 3810 may replace the leaderboard 210 in the user interface 200 of FIG. 2A. The leaderboard 3810 may include a first user indicator 3820, a trainer indicator 3830, and comparative user indicators 3840. The indicators 3820-3840 may include performance metrics for their respective user or trainer associated with a time in the workout program corresponding to a current execution of the workout program by the first user. The indicators 3820-3840 may include a visual indication of the performance metrics for their respective user. The visual indication shows performance metrics or relative performance metrics using shape, size, color, texture, or other visual characteristics. For example, the indicators 3820-3840 may each include a bar showing relative distance traveled. The bars may have different colors based on the relative distance traveled.

Comparative users corresponding to the comparative user indicators 3840 may be a selected subset of all of the users who are currently executing or who have executed the workout program. The comparative users may be selected based on similarity to the first user. Similarity to the first user may be determined by comparing user parameters of the comparative users to user parameters of the first user. The user parameters may include age, sex, weight, athletic ability, recent workout history, and other parameters. The user parameters may be collected by one or more sensors on the exercise device. For example, the user parameters may be collected by heart rate sensors, weight sensors, pulse oximeter sensors, camera sensors, infrared sensors, any other type of sensor, and combinations thereof. The user parameters may be weighted or have a weight assigned (e.g., an assigned weight) to the user parameters to determine similarity of each user to the first user. In some embodiments, a similarity score for each user of all of the users may be calculated based on the weighted user parameters of each user. A ranked list of all of the users may be generated based on the similarity score for each user. The comparative users may be selected from the ranked list based on their similarity scores. In other embodiments, an artificial intelligence may utilize machine learning to assign weights to and/or to prepare assigned weights of user parameters and select the comparative users based on historical selections of comparative users. The artificial intelligence may receive feedback to refine its selection of comparative users. In some embodiments, the artificial intelligence may determine a number of comparative users to be selected. The artificial intelligence may receive feedback to refine its determination of the number of comparative users to be selected. Feedback may be input by the first user or obtained by other means. The feedback (e.g., the received input) may be based on how motivated the first user felt, a change in the first user's performance metrics, a change in the frequency of the first user's exercise, a change in the consistency of the first user's exercise, or other data.

The leaderboard 3810 may include a ranking which shows a rank of the first user as compared to the comparative users. The leaderboard 3810 may include a performance metric selector which allows the first user to select a performance metric to display in the indicators 3820-3840. The ranking may depend upon the performance metric selected. For example, the first user may be ranked first by distance, be ranked second by output, and be ranked fourth by calories burned. The indicators 3820-3840 may include a leader icon showing which user is in the lead. For example, the first user indicator 3820 may include a gold medal showing that the first user is ranked first when compared against the comparative users.

The comparative users may depend upon one or more filters selected by the first user. For example, if the first user filters by age to only include participants over thirty, the comparative users are selected from the subset of users over thirty. Filters may be selected at any time during the workout program. The comparative users may be selected as the first user selects filters or and/or sets of comparative users corresponding to various filters may be selected before the user selects any filters. The sets of comparative users may be preselected based on a popularity of specific filters and/or a pattern of the first user selecting the specific filters. The leaderboard 3810 may include community statistics 3850. The community statistics 3850 may display a number of participants in the workout program as well as one or more average performance metrics. The number of participants as well as the average performance metrics may depend upon the filters selected by the first user.

An order of the first user indicator 3820, the trainer indicator 3830, and the other user indicators 3840 may be determined based on one or more metrics, one or more user parameters, or another parameter. In some embodiments, the trainer indicator 3830 and the first user indicator 3820 will be above the other user indicators 3840. In other embodiments, the order of the indicators 3820-3840 may be random. A new order of indicators 3820-3840 may be generated based on a new set of other user indicators 3840 being displayed due to selection of one or more filters by the first user, as discussed herein.

The leaderboard 3810 may include a toggle 3870. The toggle 3870 may include a myself position, a community position, and a friends position. The toggle 3870 may determine what is being compared on the leaderboard. Additional detail is in FIGS. 41 and 42.

The leaderboard 3810 may include simulated users having simulated performance metrics, as discussed herein. In some embodiments, the simulated performance metrics may be based on simulated user parameters of the simulated users. In other embodiments, the simulated performance metrics may be based on aggregated performance metrics from multiple users. The simulated users may be identified as simulated users on the leaderboard 3810, or they may not be identified as simulated users. In some embodiments, the simulated users will be used in generating the leaderboard 3810 for all users participating in the workout program. In other embodiments, the simulated users will be used in generating the leaderboard 3810 for a subset of users participating in the workout program. Different simulated users may be generated for different subsets of users participating in the workout program. The first user may have a corresponding personal simulated user which is included in the leaderboard 3810. The personal simulated user may be based on user parameters, workout history, or other characteristics of the first user. The personal simulated user may be generated so as to be ranked first in the ranked list of users ranked by similarity to the first user. The personal simulated user may be based on an aggregation of friends of the user and/or an aggregation of the comparative users. The first user may tune the personal simulated user. The first user may tune the personal simulated user to have scaled performance metrics. The first user may tune the personal simulated user to be based on an aggregation of specific users. The first user may tune which simulated users are included in the leaderboard 3810 and/or in the comparative users. The first user may filter out simulated users. The first user select a filter which removes some simulated users and retains other simulated users. For example, the first user may select one or more filters to include more competitive simulated users, less competitive simulated users, simulated users having greater variability of performance metrics, and/or simulated users having lower variability of performance metrics.

Figure 39:
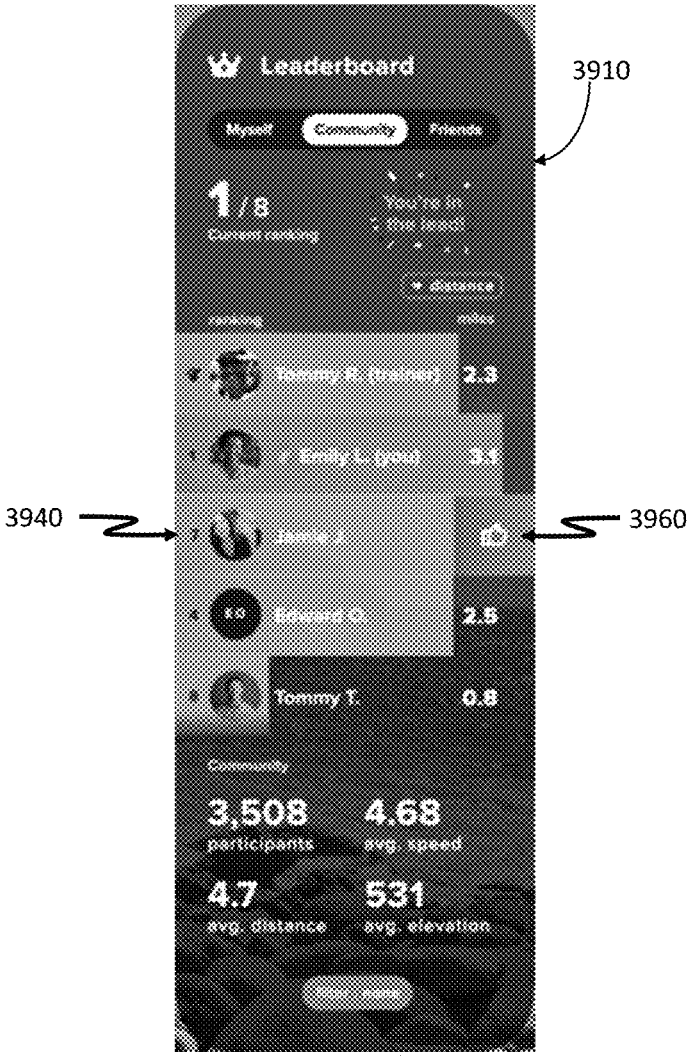
FIG. 39 is yet another example leaderboard, in accordance with one or more embodiments.

FIG. 39 is yet another example leaderboard 3910, in accordance with one or more embodiments. The leaderboard 3910 may replace the leaderboard 210 in the user interface 200 of FIG. 2A. The leaderboard 3910 may include an other user indicator 3940. The first user may tap or swipe the other user indicator 3940 to display a social callout button 3960. The social callout button 3960 may be used to generate a social callout to the user associated with the other user indicator 3940. The social callout may include encouragement, approval, disapproval, discouragement, or other social messages. The social callout may be visible to the user associated with the other user indicator 3940, the first user, and/or other users in the workout program.

Figure 40:
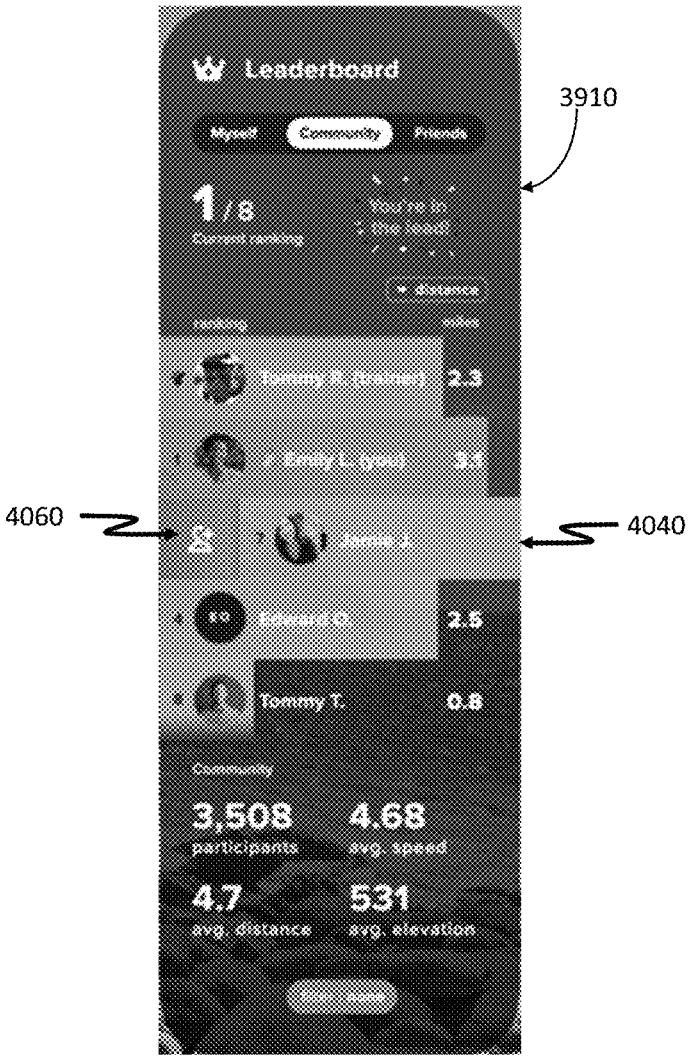
FIG. 40 is yet another example leaderboard, in accordance with one or more embodiments.

FIG. 40 is yet another example leaderboard, in accordance with one or more embodiments. The leaderboard 4010 may replace the leaderboard 210 in the user interface 200 of FIG. 2A. The leaderboard 4010 may include an other user indicator 4040. The first user may tap or swipe the other user indicator 4040 to display an add friend button 4060. The add friend button 4060 may be used to add the user associated with the other user indicator 4040 to a friends list of the first user. The user associated with the other user indicator 4040 may have the option to accept or decline friend request of the first user before being added to the friends list of the first user.

Figure 41:
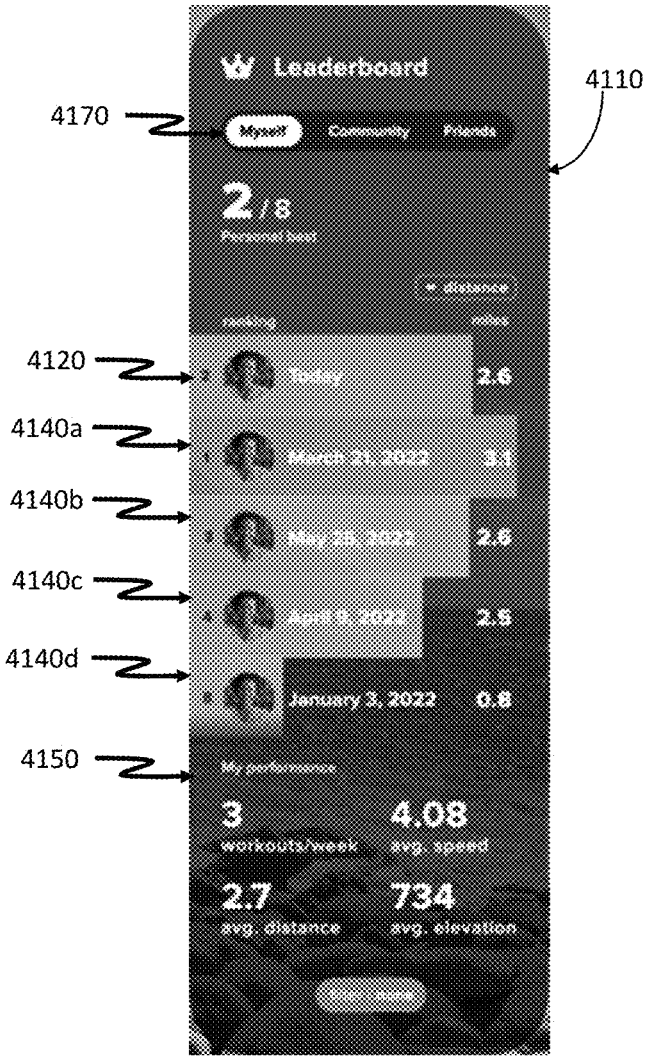
FIG. 41 is yet another example leaderboard, in accordance with one or more embodiments.

FIG. 41 is yet another example leaderboard 4110, in accordance with one or more embodiments. The leaderboard 4110 may replace the leaderboard 210 in the user interface 200 of FIG. 2A. The leaderboard 4110 may include a toggle 4170. The toggle 4170 may include a myself position, a community position, and a friends position. The toggle 4170 may determine what is being compared on the leaderboard. The leaderboard 4110 may be the leaderboard 3810 with the toggle 4170 in the myself position. The leaderboard 4110 may compare the first user's current performance metrics to performance metrics of one or more past instances of the first user performing the workout. The leaderboard 4110 may include a current first user indicator 4120 and past first user indicators 4140. The current first user indicator 4120 may display current performance metrics of the first user executing the workout program. The past first user indicators 4140 may indicate past performance metrics of the first user executing the workout program at different times. The leaderboard 4110 may include aggregate performance statistics 4150 which display statistics of the first user's performance metrics aggregated from multiple instances of the first user executing the workout program. The aggregate performance statistics 4150 may include a frequency of workouts, an average speed, an average distance, an average elevation, and other parameters.

Figure 42:
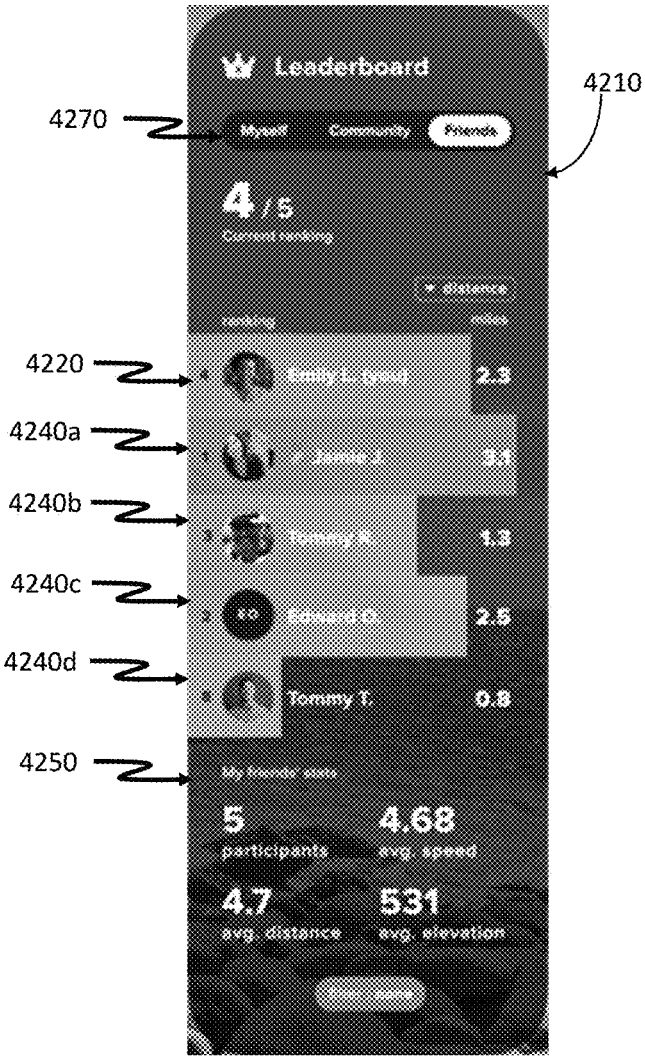
FIG. 42 is yet another example leaderboard, in accordance with one or more embodiments.

FIG. 42 is yet another example leaderboard 4210, in accordance with one or more embodiments. The leaderboard 4210 may replace the leaderboard 210 in the user interface 200 of FIG. 2A. The leaderboard 4210 may include a toggle 4270. The toggle 4270 may include a myself position, a community position, and a friends position. The toggle 4270 may determine what is being compared on the leaderboard. The leaderboard 4210 may be the leaderboard 3810 with the toggle 4270 in the friends position. The leaderboard 4210 may compare the first user's performance metrics with performance metrics of friends of the first user. Friends of the first user may be selected from the friends list of the first user. Comparative users may be selected from the friends list of the first user as discussed herein. The leaderboard 4210 may include friends statistics 4250 including aggregate performance metrics of the friends displayed on the leaderboard 4210.

Figure 43:
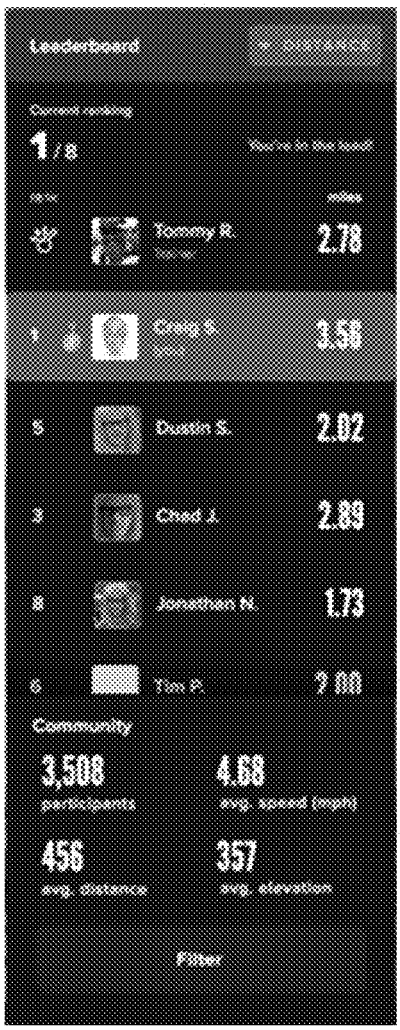
FIG. 43 is yet another example leaderboard, in accordance with one or more embodiments.
Figure 44:
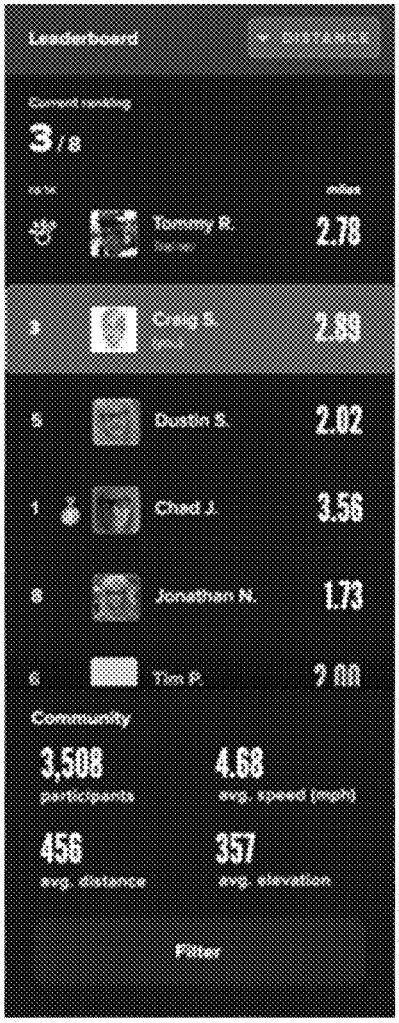
FIG. 44 is yet another example leaderboard, in accordance with one or more embodiments.

FIGS. 43 and 44 are example leaderboards, in accordance with one or more embodiments.

Figure 45:
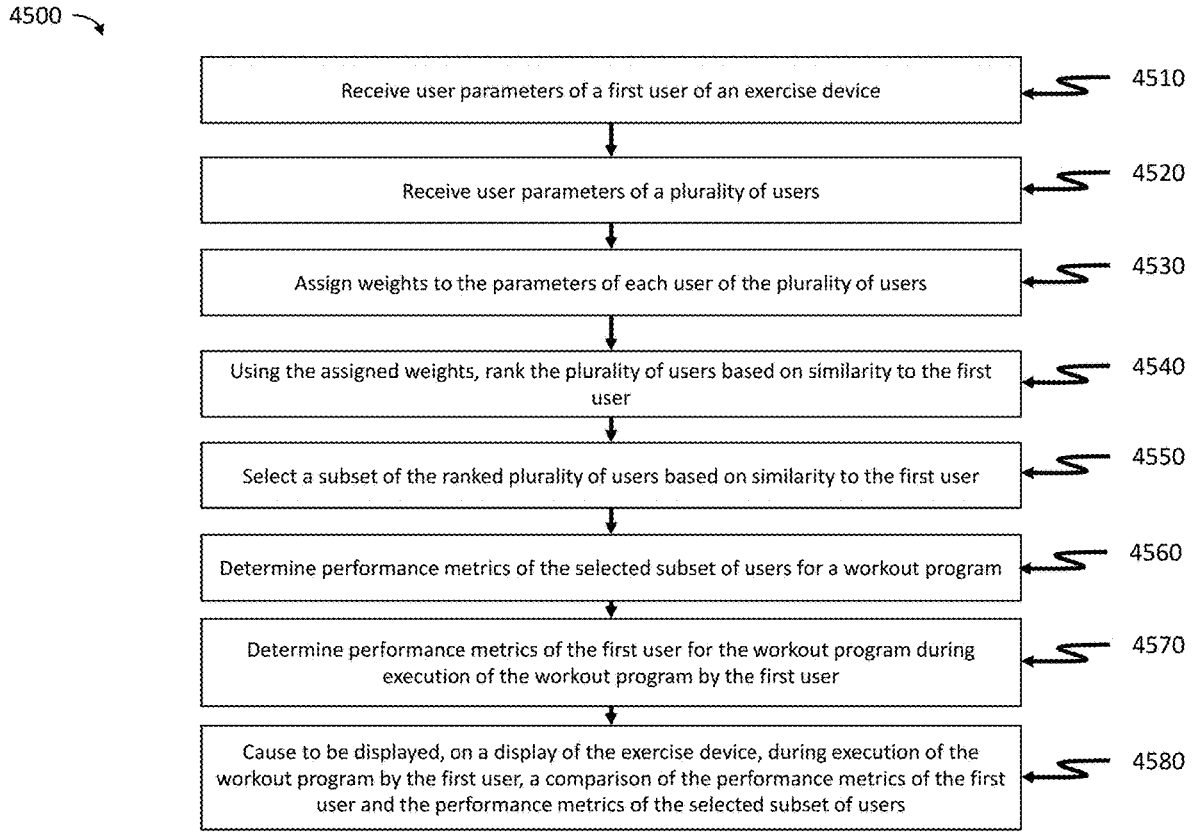
FIG. 45 is an example flowchart illustrating operations for selecting a subset of users for a leaderboard in accordance with one or more embodiments.

FIG. 45 is an example flowchart 4500 illustrating operations for selecting a subset of users for a leaderboard in accordance with one or more embodiments. Additional, fewer, or different operations may be performed in the method, depending on the embodiment. Further, the operations may be performed in the order shown, concurrently, or in a different order. The operations may be performed by elements of the environment 100 of FIG. 1. For example, the operations of the flowchart 4500 may be performed by the server 103 of FIG. 1.

At 4510, the server may receive user parameters of a first user of an exercise device. At 4520, the server receives user parameters of a plurality of users. User parameters may include age, sex, weight, athletic ability, workout history, and other parameters. At 4530, the server assigns weights to or prepares assigned weights of the parameters of each user of the plurality of users. The assigned weights may be assigned by an artificial intelligence executing a first machine learning algorithm on the server based on historic assignments of weights and/or historic assigned weights. At 4540, the server, using the assigned weights, ranks the plurality of users based on similarity to the first user. The users may be ranked by the artificial intelligence executing a second machine learning algorithm on the server based on historic rankings of users. At 4550, the server selects a subset of the ranked plurality of users. In some embodiments, the subset is selected based on the subset satisfying a similarity threshold. In other embodiments, the subset is selected based on the most similar users in the ranked plurality of users. In yet other embodiments, the subset is selected by the artificial intelligence executing a third machine learning algorithm based on historic selections of the subset. At 4560, the server determines performance metrics of the selected subset of users for a workout program. Performance metrics may be collected by sensors of exercise devices and stored at the server. At 4570, the server determines performance metrics of the first user for the workout program during execution of the workout program by the first user. At 4580, the server causes to be displayed, on a display of the exercise device, during execution of the workout program by the first user, a comparison of the performance metrics of the first user and the performance metrics of the selected subset of users. The comparison may include a leaderboard displaying a ranking of the performance metrics of the first user and the performance metrics of the selected subset of users.

Certain components may be included within a computer system. One or more computer systems may be used to implement the various devices, components, and systems described herein. The computer system may include a computer-readable medium that includes stored retrievable stored instructions that cause a processor to perform the acts of the systems and methods described herein.

The computer system includes a processor. The processor may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor may be referred to as a central processing unit (CPU). Although just a single processor is discussed, in an alternative configuration, a combination of processors (e.g., an ARM and DSP) could be used.

The computer system also includes memory in electronic communication with the processor. The memory may be any electronic component capable of storing electronic information. For example, the memory may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions and data may be stored in the memory. The instructions may be executable by the processor to implement some or all of the functionality disclosed herein. Executing the instructions may involve the use of the data that is stored in the memory. Any of the various examples of modules and components described herein may be implemented, partially or wholly, as instructions stored in memory and executed by the processor. Any of the various examples of data described herein may be among the data that is stored in memory and used during execution of the instructions by the processor.

A computer system may also include one or more communication interfaces for communicating with other electronic devices. The communication interface(s) may be based on wired communication technology, wireless communication technology, or both. Some examples of communication interfaces include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

A computer system may also include one or more input devices and one or more output devices. Some examples of input devices include a keyboard, mouse, microphone, remote control device, button, joystick, trackball, touchpad, and lightpen. Some examples of output devices include a speaker and a printer. One specific type of output device that is typically included in a computer system is a display device. Display devices used with embodiments disclosed herein may utilize any suitable image projection technology, such as liquid crystal display (LCD), light-emitting diode (LED), gas plasma, electroluminescence, or the like. A display controller may also be provided, for converting data stored in the memory into text, graphics, and/or moving images (as appropriate) shown on the display device.

The various components of the computer system may be coupled together by one or more buses, which may include a power bus, a control signal bus, a status signal bus, a data bus, etc. For the sake of clarity, the various buses are discussed as a bus system.

INDUSTRIAL APPLICABILITY

Comparing performance of users of exercise equipment using a leaderboard can be an effective tool for motivating the users of the exercise equipment to exercise more intensely and more frequently. However, dynamically comparing performance metrics for many tens, hundreds, or thousands of users is computationally expensive. Additionally, many users may not be motivated by a comparison of their performance to the performance of a large number of other users. The present disclosure solves these problems by intelligently selecting a subset of users performing a workout for comparison on a leaderboard. Dynamically comparing the performance metrics of the subset of users is computationally less expensive than dynamically comparing performance metrics of all users performing the workout. The subset of users may be selected based on similar attributes. A first user performing a workout may be compared to all users who are performing or who have performed the workout to determine a subset of all the users which are similar to the first user. A leaderboard may compare performance metrics of the first user to performance metrics of the similar users of the subset of all the users. This leaderboard comparison is less computationally expensive than a leaderboard comparison of performance metrics of all the users to the performance metrics of the first user, and the first user may be more motivated by this leaderboard comparison of the subset of users than by a leaderboard comparison of all the users. The first user may find it more meaningful to compete against a group of similar users than against a crowd of users, many of which are dissimilar to the user. Thus, the present disclosure solves the technical problem of computationally expensive leaderboard comparisons and the technical problem of providing a meaningful leaderboard comparison.

An exercise environment may include a first exercise machine, a second exercise machine, a third exercise machine, and an nth exercise machine, referred to collectively as exercise machines. The exercise machines may communicate with a server via a network. The network may be any wide area network (WAN), local area network (LAN), or any other type of network. For example, the network may be the Internet. The exercise machines may include movable or moving members which are associated with exercise parameters such as incline, resistance, cadence, speed, distance, pace, power, calories, and time elapsed. The exercise machines may be treadmills, exercise bikes, rowers, ellipticals, or other exercise devices. The exercise machines may transmit exercise parameters determined during a workout to the server via the network. The server may host a workout program and transmit the workout program to the exercise machines. The server may compare the exercise parameters determined during the workout and rank them. The server may generate a leaderboard using the exercise parameters and transmit the leaderboard to the exercise machines via the network. The exercise parameters may be transmitted asynchronously or simultaneously. A first user of the first exercise machine may perform the workout program at a first time and a second user of the second exercise machine may perform the workout program at a second time different from the first time. The server may compare exercise parameters of the first exercise machine collected during the workout program at the first time to exercise parameters of the second exercise machine collected during the workout program at the second time. The server may generate a leaderboard based on the comparison of exercise parameters of the first exercise machine collected during the workout program at the first time to exercise parameters of the second exercise machine collected during the workout program at the second time. The server may convert the exercise parameters into performance metrics for a user of each respective exercise machine. Each user of any of the exercise machines may view a leaderboard generated for the workout program using exercise parameters of each other user of the exercise machines who performed the workout program previously.

The server may generate simulated performance metrics for simulated users. In some embodiments, the simulated performance metrics may be based on simulated user parameters of the simulated users. In other embodiments, the simulated performance metrics may be based on aggregated performance metrics from multiple users. The server may include the simulated performance metrics and simulated users in comparing performance metrics of all users who performed the workout and in generating the leaderboard. The simulated users may be identified as simulated users on the leaderboard, or they may not be identified as simulated users. In some embodiments, the simulated users will be used in generating the leaderboard for all users participating in the workout program. In other embodiments, the simulated users will be used in generating the leaderboard for a subset of users participating in the workout program. Different simulated users may be generated for different subsets of users participating in the workout program. Each user may have a corresponding personal simulated user which is included in the leaderboard of each user. The personal simulated user may be based on user parameters, workout history, or other characteristics of the user. The user parameters may be received by a single user that has previously used the exercise device. In some embodiments, the user parameters may be received by multiple users that have previously used the exercise device. For example, the personal simulated user may be based on an aggregation of friends of the user and/or an aggregation of other users similar to the user.

A user interface may display (e.g., the computing device may cause to be displayed) user performance metrics including, but not limited to, incline, resistance, cadence, speed, heart rate, distance, pace, power, calories, time elapsed, and score. The performance metrics may be captured by an exercise device including a display for displaying the user interface. The user interface may be used in conjunction with a workout program. The workout program may include video and audio of a trainer presenting the workout program. The user interface may include a leaderboard. The leaderboard may display (e.g., the computing device may cause to be displayed) a comparison of performance metrics of a plurality of users. A first user may use an exercise machine and generate performance metrics. The first user may view the user interface including the performance metrics generated as the first user performs the workout program. The leaderboard may include a first user indicator including first user performance metrics. The leaderboard may display a comparison of the first user performance metrics and performance metrics of a plurality of other users. The first user may view the leaderboard on the user interface as the first user performs the workout program.

The leaderboard may include the first user indicator, an up ahead user indicator, and a from behind user indicator. The first user indicator, the up ahead user indicator, and the from behind user indicator may all display the same performance metrics of different users. For example, the indicators may display a rank, a visual indicator, a speed, and a distance. The up ahead user indicator may display performance metrics of a user ranked just above the first user and the from behind user indicator may display performance metrics of a user just behind the first user. The up ahead user indicator and the from behind user indicator may or may not display user information of their respective users.

The leaderboard may include indicators of performance metrics such as time, distance, watts, and elevation. The indicators may be interactive and, when selected, may cause the leaderboard to display the selected performance metric in each of the user indicators. The leaderboard may include an indication of which performance metric is currently displayed. The leaderboard shows, for example, miles. The leaderboard may include a rank total, indicating a total number of users in the leaderboard. As discussed herein, subsequent leaderboards may replace preceding leaderboards. Put another way preceding leaderboards may be updated with the content of subsequent leaderboards. In some embodiments, the entire leaderboard may be replaced or updated. In some embodiments, a portion of the leaderboard may be replaced or updated.

The leaderboard may compare the first user's performance metrics to trainer performance metrics. The trainer performance metrics may correspond to the video of the trainer in the workout program. The leaderboard may also display (e.g., the computing device may cause the leaderboard to display) a rank of the first user based on comparing the first user's performance metrics to performance metrics of all users who have performed the workout routine.

The leaderboard may compare the first user's current performance metrics to trainer performance metrics and performance metrics of one or more past instances of the first user performing the workout. The first user can compete against their past performance, with the trainer performance metrics as a benchmark. Indicators of the one or more past instances of the first user performing the workout may display the date on which the performance metrics were captured.

The leaderboard may compare the first user's current performance metrics to trainer performance metrics and performance metrics of one or more past instances of the first user performing the workout. The leaderboard may also include a linear indicator comparing the first user's performance metrics to performance metrics of users of similar rank to the first user. Icons on the linear indicator may represent other users who are currently executing or who have previously executed the workout program. The position of the icons may correspond to performance metrics. The relative position of the icons may indicate relative achievement along the performance metric currently displayed. The first user may be able to see how their performance metrics compare to performance metrics of other riders of similar rank. For example, when the performance metric current display is distance, the first user can see how close their distance metric is to the distance metrics of other users at a current time as the first user executes the workout program, and how a change in the first user's distance metric over time compares to a change in the previous users' distance metric over time.

In some embodiments, the linear indicator may include icons representing all other users who are currently executing or who have executed the workout program. In other embodiments, the linear indicator may include icons representing other users who are similar to the first user. The other users who are similar to the first user may be selected as discussed herein.

The leaderboard may compare the first user's current performance metrics to trainer performance metrics and performance metrics of one or more past instances of the first user performing the workout. The leaderboard may include the previous indicator. The leaderboard may include community statistics. The community statistics may include a number of participants as well as average performance metrics. The community statistics may depend upon one or more filters applied by the first user. Filters may be based on age, sex, location, athletic ability, and other user parameters. For example, the user may filter other users by age to include only other users older than thirty. The linear indicator will then only include icons corresponding to the other users over thirty and the community statistics will include a number of the other users over thirty and average performance metrics of the other users over thirty. The first user may apply multiple filters. For example, the first user may apply filters to only see performance metrics corresponding to other users who are male and over thirty.

The leaderboard may compare the first user's current performance metrics to trainer performance metrics and performance metrics of one or more past instances of the first user performing the workout. The leaderboard may include a linear indicator, but with the additional detail of number values associated with the icons representing the performance metrics of other users who are currently executing, or who have executed, the workout program. The number values may indicate the value of the performance metrics of the other users at a time in the workout program corresponding to a current time as the first user executes the workout program.

The leaderboard may compare the first user's current performance metrics to performance metrics of one or more past instances of the first user performing the workout. For example, the leaderboard may compare a rank of the first user to a rank of a past instance of the first user performing the workout. The leaderboard may include the linear indicator.

The leaderboard may include a first user indicator, a trainer indicator, and comparative user indicators. The indicators may include performance metrics for their respective user or trainer associated with a time in the workout program corresponding to a current execution of the workout program by the first user. The indicators may include a visual indication of the performance metrics for their respective user. The visual indication show performance metrics or relative performance metrics using shape, size, color, texture, or other visual characteristics. For example, the indicators may each include a bar showing relative distance traveled. The bars may have different colors based on the relative distance traveled.

Comparative users corresponding to the comparative user indicators may be a selected subset of all of the users who are currently executing or who have executed the workout program. The comparative users may be selected based on similarity to the first user. Similarity to the first user may be determined by comparing user parameters of the comparative users to user parameters of the first user. The user parameters may include age, sex, weight, athletic ability, recent workout history, and other parameters. The user parameters may be collected by one or more sensors on the exercise device. For example, the user parameters may be collected by heart rate sensors, weight sensors, pulse oximeter sensors, camera sensors, infrared sensors, any other type of sensor, and combinations thereof. The user parameters may be weighted or have a weight assigned (e.g., an assigned weight) to the user parameters to determine similarity of each user to the first user. In some embodiments, a similarity score for each user of all of the users may be calculated based on the weighted user parameters of each user. A ranked list of all of the users may be generated based on the similarity score for each user. The comparative users may be selected from the ranked list based on their similarity scores. In other embodiments, an artificial intelligence may utilize machine learning to assign weights to and/or to prepare assigned weights of user parameters and select the comparative users based on historical selections of comparative users. The artificial intelligence may receive feedback to refine its selection of comparative users. In some embodiments, the artificial intelligence may determine a number of comparative users to be selected. The artificial intelligence may receive feedback to refine its determination of the number of comparative users to be selected. Feedback may be input by the first user or obtained by other means. The feedback (e.g., the received input) may be based on how motivated the first user felt, a change in the first user's performance metrics, a change in the frequency of the first user's exercise, a change in the consistency of the first user's exercise, or other data.

The leaderboard may include a ranking which shows a rank of the first user as compared to the comparative users. The leaderboard may include a performance metric selector which allows the first user to select a performance metric to display in the indicators. The ranking may depend upon the performance metric selected. For example, the first user may be ranked first by distance, be ranked second by output, and be ranked fourth by calories burned. The indicators may include a leader icon showing which user is in the lead. For example, the first user indicator may include a gold medal showing that the first user is ranked first when compared against the comparative users.

The comparative users may depend upon one or more filters selected by the first user. For example, if the first user filters by age to only include participants over thirty, the comparative users are selected from the subset of users over thirty. Filters may be selected at any time during the workout program. The comparative users may be selected as the first user selects filters or and/or sets of comparative users corresponding to various filters may be selected before the user selects any filters. The sets of comparative users may be preselected based on a popularity of specific filters and/or a pattern of the first user selecting the specific filters. The leaderboard may include community statistics. The community statistics may display a number of participants in the workout program as well as one or more average performance metrics. The number of participants as well as the average performance metrics may depend upon the filters selected by the first user.

An order of the first user indicator, the trainer indicator, and the other user indicators may be determined based on one or more metrics, one or more user parameters, or another parameter. In some embodiments, the trainer indicator and the first user indicator will be above the other user indicators. In other embodiments, the order of the indicators may be random. A new order of indicators may be generated based on a new set of other user indicators being displayed due to selection of one or more filters by the first user, as discussed herein.

The leaderboard may include a toggle. The toggle may include a myself position, a community position, and a friends position. The toggle may determine what is being compared on the leaderboard.

The leaderboard may include simulated users having simulated performance metrics, as discussed herein. In some embodiments, the simulated performance metrics may be based on simulated user parameters of the simulated users. In other embodiments, the simulated performance metrics may be based on aggregated performance metrics from multiple users. The simulated users may be identified as simulated users on the leaderboard, or they may not be identified as simulated users. In some embodiments, the simulated users will be used in generating the leaderboard for all users participating in the workout program. In other embodiments, the simulated users will be used in generating the leaderboard for a subset of users participating in the workout program. Different simulated users may be generated for different subsets of users participating in the workout program. The first user may have a corresponding personal simulated user which is included in the leaderboard. The personal simulated user may be based on user parameters, workout history, or other characteristics of the first user. The personal simulated user may be generated so as to be ranked first in the ranked list of users ranked by similarity to the first user. The personal simulated user may be based on an aggregation of friends of the user and/or an aggregation of the comparative users. The first user may tune the personal simulated user. The first user may tune the personal simulated user to have scaled performance metrics. The first user may tune the personal simulated user to be based on an aggregation of specific users. The first user may tune which simulated users are included in the leaderboard and/or in the comparative users. The first user may filter out simulated users. The first user select a filter which removes some simulated users and retains other simulated users. For example, the first user may select one or more filters to include more competitive simulated users, less competitive simulated users, simulated users having greater variability of performance metrics, and/or simulated users having lower variability of performance metrics.

The leaderboard may include another user indicator. The first user may tap or swipe the other user indicator to display a social callout button. The social callout button may be used to generate a social callout to the user associated with the other user indicator. The social callout may include encouragement, approval, disapproval, discouragement, or other social messages. The social callout may be visible to the user associated with the other user indicator, the first user, and/or other users in the workout program.

The leaderboard may include another user indicator. The first user may tap or swipe the other user indicator to display an add friend button. The add friend button may be used to add the user associated with the other user indicator to a friends list of the first user. The user associated with the other user indicator may have the option to accept or decline friend request of the first user before being added to the friends list of the first user.

The leaderboard may include a toggle. The toggle may include a myself position, a community position, and a friends position. The toggle may determine what is being compared on the leaderboard. The leaderboard may be the leaderboard with the toggle in the myself position. The leaderboard may compare the first user's current performance metrics to performance metrics of one or more past instances of the first user performing the workout. The leaderboard may include a current first user indicator and past first user indicators. The current first user indicator may display current performance metrics of the first user executing the workout program. The past first user indicators may indicate past performance metrics of the first user executing the workout program at different times. The leaderboard may include aggregate performance statistics which display statistics of the first user's performance metrics aggregated from multiple instances of the first user executing the workout program. The aggregate performance statistics may include a frequency of workouts, an average speed, an average distance, an average elevation, and other parameters.

The leaderboard may include a toggle. The toggle may include a myself position, a community position, and a friends position. The toggle may determine what is being compared on the leaderboard. The leaderboard may be the leaderboard with the toggle in the friends position. The leaderboard may compare the first user's performance metrics with performance metrics of friends of the first user. Friends of the first user may be selected from the friends list of the first user. Comparative users may be selected from the friends list of the first user as discussed herein. The leaderboard may include friends statistics including aggregate performance metrics of the friends displayed on the leaderboard.

A server may receive user parameters of a first user of an exercise device. The server receives user parameters of a plurality of users. User parameters may include age, sex, weight, athletic ability, workout history, and other parameters. The server assigns weights to or prepares assigned weights of the parameters of each user of the plurality of users. The assigned weights may be assigned by an artificial intelligence executing a first machine learning algorithm on the server based on historic assignments of weights and/or historic assigned weights. The server, using the assigned weights, ranks the plurality of users based on similarity to the first user. The users may be ranked by the artificial intelligence executing a second machine learning algorithm on the server based on historic rankings of users. The server selects a subset of the ranked plurality of users. In some embodiments, the subset is selected based on the subset satisfying a similarity threshold. In other embodiments, the subset is selected based on the most similar users in the ranked plurality of users. In yet other embodiments, the subset is selected by the artificial intelligence executing a third machine learning algorithm based on historic selections of the subset. The server determines performance metrics of the selected subset of users for a workout program. Performance metrics may be collected by sensors of exercise devices and stored at the server. The server determines performance metrics of the first user for the workout program during execution of the workout program by the first user. The server causes to be displayed, on a display of the exercise device, during execution of the workout program by the first user, a comparison of the performance metrics of the first user and the performance metrics of the selected subset of users. The comparison may include a leaderboard displaying a ranking of the performance metrics of the first user and the performance metrics of the selected subset of users.

A processor may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, a computer-readable medium, etc. The processor may be referred to as a central processing unit (CPU). Although just a single processor is discussed, in an alternative configuration, a combination of processors (e.g., an ARM and DSP) could be used.

The computer system also includes memory in electronic communication with the processor. The memory may be any electronic component capable of storing electronic information. For example, the memory may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions and data may be stored in the memory. The instructions may be executable by the processor to implement some or all of the functionality disclosed herein. Executing the instructions may involve the use of the data that is stored in the memory. Any of the various examples of modules and components described herein may be implemented, partially or wholly, as instructions stored in memory and executed by the processor. Any of the various examples of data described herein may be among the data that is stored in memory and used during execution of the instructions by the processor.

A computer system may also include one or more communication interfaces for communicating with other electronic devices. The communication interface(s) may be based on wired communication technology, wireless communication technology, or both. Some examples of communication interfaces include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

A computer system may also include one or more input devices and one or more output devices. Some examples of input devices include a keyboard, mouse, microphone, remote control device, button, joystick, trackball, touchpad, and lightpen. Some examples of output devices include a speaker and a printer. One specific type of output device that is typically included in a computer system is a display device. Display devices used with embodiments disclosed herein may utilize any suitable image projection technology, such as liquid crystal display (LCD), light-emitting diode (LED), gas plasma, electroluminescence, or the like. A display controller may also be provided, for converting data stored in the memory into text, graphics, and/or moving images (as appropriate) shown on the display device.

The various components of the computer system may be coupled together by one or more buses, which may include a power bus, a control signal bus, a status signal bus, a data bus, etc.

The example leaderboards discussed herein are provided for example only and are not limiting. Additionally, elements from example leaderboards may be incorporated into other example leaderboards.

It is to be understood that any examples used herein are simply for purposes of explanation and are not intended to be limiting in any way. It is also to be understood that any examples used herein are simply for purposes of explanation and are not intended to be limiting in any way. Further, although the present disclosure has been discussed with respect to memory usage, in other embodiments, the teachings of the present disclosure may be applied to adjust other resources, such as power, processing capacity, etc.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

Following are sections in accordance with at least one embodiment of the present disclosure:

A1. A computer-readable medium containing instructions which, when executed by a processor, cause the processor to:

- receive user parameters of a first user of an exercise device;
- receive user parameters of a plurality of users;
- assign weights to the user parameters of the plurality of users;
- using the assigned weights, rank the plurality of users based on similarity to the first user;
- select a subset of the ranked plurality of users based on similarity to the first user;
- determine a performance metric of the selected subset of users for a workout program;
- determine a performance metric of the first user for the workout program during execution of the workout program by the first user; and
- cause to be displayed, on a display of the exercise device, during execution of the workout program by the first user, a comparison of the performance metric of the first user and the performance metric of the selected subset of users.

A2. The medium of claim A1, wherein displaying the comparison of the performance metric of the first user and the performance metric of the selected subset of users comprises displaying a leaderboard including a ranking of the first user and the selected subset of users.

A3. The medium of claim A2, wherein an order of the first user and the selected subset of users on the leaderboard is determined based on the performance metric of the first user and the performance metric of the selected subset of users.

A4. The medium of claim A2, wherein an order of the first user and the selected subset of users on the leaderboard is determined based on one or more user parameters of the first user and the selected subset of users.

A5. The medium of claim A2, further comprising instructions which, when executed by a processor, cause the processor to:

based on receiving input from the first user selecting a performance metric, display, on the display of the exercise device, a comparison of the selected performance metric of the first user and the selected performance metric of the selected subset of users.

A6. The medium of claim A5, wherein an order of the first user and the selected subset of users on the leaderboard is modified based on the received input from the first user selecting a performance metric.

A7. The medium of claim A2, wherein selecting the subset of the ranked plurality of users comprises applying a filter selected by the first user.

B1. A system comprising:

an exercise device comprising a display and one or more sensors; and a server configured to:

receive user parameters of a first user of the exercise device;

receive user parameters of a plurality of users;

assign weights to the user parameters of the plurality of users;

using the assigned weights, rank the plurality of users based on similarity to the first user;

select a subset of the ranked plurality of users based on similarity to the first user;

determine a performance metric of the selected subset of users for a workout program;

determine a performance metric of the first user for the workout program during execution of the workout program by the first user; and cause to be displayed, on the display of the exercise device, during execution of the workout program by the first user, a comparison of the performance metric of the first user and the performance metric of the selected subset of users.

B2. The system of claim B1, wherein the server is configured to display the comparison of the performance metric of the first user and the performance metric of the selected subset of users by displaying a leaderboard including a ranking of the first user and the selected subset of users.

B3. The system of claim B2, wherein the server is configured to determine an order of the first user and the selected subset of users on the leaderboard based on the performance metric of the first user and the performance metric of the selected subset of users.

B4. The system of claim B2, wherein the server is configured to determine an order of the first user and the selected subset of users on the leaderboard based on one or more user parameters of the first user and the selected subset of users.

B5. The system of claim B2, wherein the server is further configured to:

based on receiving input from the first user selecting a performance metric, cause to be displayed, on the display of the exercise device, a comparison of the selected performance metric of the first user and the selected performance metric of the selected subset of users.

B6. The system of claim B5, wherein the server is configured to modify an order of the first user and the selected subset of users on the leaderboard based on the received input from the first user selecting a performance metric.

B7. The system of claim B2, wherein the server is configured to select the subset of the ranked plurality of users by applying a filter selected by the first user.

C1. A method comprising:

receiving user parameters of a first user of an exercise device;

receiving user parameters of a plurality of users;

assigning weights to the user parameters of the plurality of users;

using the assigned weights, ranking the plurality of users based on similarity to the first user;

selecting a subset of the ranked plurality of users based on similarity to the first user;

determining a performance metric of the selected subset of users for a workout program;

determining a performance metric of the first user for the workout program during execution of the workout program by the first user; and causing to be displayed, on a display of the exercise device, during execution of the workout program by the first user, a comparison of the performance metric of the first user and the performance metric of the selected subset of users.

C2. The method of claim C1, wherein displaying the comparison of the performance metric of the first user and the performance metric of the selected subset of users comprises displaying a leaderboard including a ranking of the first user and the selected subset of users.

C3. The method of claim C2, wherein an order of the first user and the selected subset of users on the leaderboard is determined based on the performance metric of the first user and the performance metric of the selected subset of users.

C4. The method of claim C2, wherein an order of the first user and the selected subset of users on the leaderboard is determined based on one or more user parameters of the first user and the selected subset of users.

C5. The method of claim C2, further comprising:

in response to receiving input from the first user selecting a performance metric, display, on the display of the exercise device, a comparison of the selected performance metric of the first user and the selected performance metric of the selected subset of users.

C6. The method of claim C2, wherein selecting the subset of the ranked plurality of users comprises applying a filter selected by the first user.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A non-transitory computer-readable medium containing instructions which, when executed by a processor of a server, cause the processor to:

receive, from a first exercise device and by a wireless adapter of the server via a network, first user parameters of a first user of the first exercise device;

receive a respective set of second user parameters of a plurality of second users, wherein the plurality of second users comprises a first quantity of users;

generate a plurality of simulated users based at least in part on receiving the respective set of second user parameters of the plurality of second users, wherein each simulated user of the plurality of simulated users corresponds to a respective second user of the plurality of second users;

assign weights to the plurality of simulated users;

using the assigned weights, rank the plurality of simulated users based on similarity to the first user;

select a subset of the ranked plurality of simulated users based on similarity to the first user, wherein the subset of the ranked plurality of simulated users comprises a second quantity of users that is less than the first quantity of users;

determine a respective second performance metric of each of the second quantity of users included in the selected subset of the plurality of simulated users for a workout program, each respective second performance metric comprising an aggregation of the respective set of second user parameters of a second user corresponding to a respective simulated user of the subset of the plurality of simulated users;

determine a first performance metric of the first user for the workout program during execution of the workout program by the first user;

compare the respective second performance metric of each of the second quantity of users included in the selected subset of the plurality of simulated users with the first performance metric of the first user, wherein a computational cost of comparing the respective second performance metric of each of the second quantity of users with the first performance metric of the first user is based at least in part on the second quantity of users; and cause to be displayed, on a display of the first exercise device, during execution of the workout program by the first user, a leaderboard indicative of the comparison of the first performance metric of the first user and the respective second performance metric of each of the second quantity of users in the selected subset of the plurality of simulated users.

2. The non-transitory computer-readable medium of claim 1, wherein the leaderboard indicative of the comparison of the first performance metric of the first user and the respective second performance metric of each of the second quantity of users in the selected subset of the plurality of simulated users comprises a ranking of the first user and the selected subset of the plurality of simulated users.

3. The non-transitory computer-readable medium of claim 1, wherein an order of the first user and the selected subset of the plurality of simulated users on the leaderboard is determined based on the first performance metric of the first user and the respective second performance metric of each of the second quantity of users in the selected subset of the plurality of simulated users.

4. The non-transitory computer-readable medium of claim 1, wherein an order of the first user and the selected subset of the plurality of simulated users on the leaderboard is determined based on one or more user parameters of the first user and the selected subset of the plurality of simulated users.

5. The non-transitory computer-readable medium of claim 1, further comprising instructions which, when executed by a processor, cause the processor to:

based on receiving input from the first user selecting a performance metric, display, on the display of the first exercise device, a comparison of the selected performance metric of the first user and the selected performance metric of the selected subset of the plurality of simulated users.

6. The non-transitory computer-readable medium of claim 5, wherein an order of the first user and the selected subset of the plurality of simulated users on the leaderboard is modified based on the received input from the first user selecting a performance metric.

7. The non-transitory computer-readable medium of claim 1, wherein selecting the subset of the ranked plurality of simulated users comprises applying a filter selected by the first user.

8. A system comprising:

an exercise device comprising a display and one or more sensors; and a server configured to:

receive, from a first exercise device and by a wireless adapter of the server via a network, first user parameters of a first user of the first exercise device;

receive a respective set of second user parameters of a plurality of second users, wherein the plurality of second users comprises a first quantity of users;

generate a plurality of simulated users based at least in part on receiving the respective set of second user parameters of the plurality of second users, wherein each simulated user of the plurality of simulated users corresponds to a respective second user of the plurality of second users;

assign weights to the plurality of simulated users;

using the assigned weights, rank the plurality of simulated users based on similarity to the first user;

select a subset of the ranked plurality of simulated users based on similarity to the first user, wherein the subset of the ranked plurality of simulated users comprises a second quantity of users that is less than the first quantity of users;

determine a respective second performance metric of each of the second quantity of users included in the selected subset of the plurality of simulated users for a workout program, each respective second performance metric comprising an aggregation of the respective set of second user parameters of a second user corresponding to a respective simulated user of the subset of the plurality of simulated users;

determine a first performance metric of the first user for the workout program during execution of the workout program by the first user;

compare the respective second performance metric of each of the second quantity of users included in the selected subset of the plurality of simulated users with the first performance metric of the first user, wherein a computational cost of comparing the respective second performance metric of each of the second quantity of users with the first performance metric of the first user is based at least in part on the second quantity of users; and cause to be displayed, on the display of the first exercise device, during execution of the workout program by the first user, a leaderboard indicative of the comparison of the first performance metric of the first user and the respective second performance metric of each of the second quantity of users in the selected subset of the plurality of simulated users.

9. The system of claim 8, wherein the leaderboard indicative of the comparison of the first performance metric of the first user and the respective second performance metric of each of the second quantity of users in the selected subset of the plurality of simulated users comprises a ranking of the first user and the selected subset of the plurality of simulated users.

10. The system of claim 8, wherein the server is configured to determine an order of the first user and the selected subset of the plurality of simulated users on the leaderboard based on the first performance metric of the first user and the respective second performance metric of each of the second quantity of users in the selected subset of the plurality of simulated users.

11. The system of claim 8, wherein the server is configured to determine an order of the first user and the selected subset of the plurality of simulated users on the leaderboard based on one or more user parameters of the first user and the selected subset of the plurality of simulated users.

12. The system of claim 9, wherein the server is further configured to:

based on receiving input from the first user selected a performance metric, cause to be displayed, on the display of the first exercise device, a comparison of the selected performance metric of the first user and the selected performance metric of the selected subset of the plurality of simulated users.

13. The system of claim 12, wherein the server is configured to modify an order of the first user and the selected subset of the plurality of simulated users on the leaderboard based on the received input from the first user selecting a performance metric.

14. The system of claim 9, wherein the server is configured to select the subset of the ranked plurality of simulated users by applying a filter selected by the first user.

15. A method comprising:

receiving, from a first exercise device and by a wireless adapter of a server via a network, first user parameters of a first user of the first exercise device;

receiving a respective set of second user parameters of a plurality of second users, wherein the plurality of second users comprises a first quantity of users;

generating a plurality of simulated users based at least in part on receiving the respective set of second user parameters of the plurality of second users, wherein each simulated user of the plurality of simulated users corresponds to a respective second user of the plurality of second users;

assigning weights to the plurality of simulated users;

using the assigned weights, rank the plurality of simulated users based on similarity to the first user;

selecting a subset of the ranked plurality of simulated users based on similarity to the first user, wherein the subset of the ranked plurality of simulated users comprises a second quantity of users that is less than the first quantity of users;

determining a respective second performance metric of each of the second quantity of users included in the selected subset of the plurality of simulated users for a workout program, each respective second performance metric comprising an aggregation of the respective set of second user parameters of a second user corresponding to a respective simulated user of the subset of the plurality of simulated users;

determining a first performance metric of the first user for the workout program during execution of the workout program by the first user;

comparing the respective second performance metric of each of the second quantity of users included in the selected subset of the plurality of simulated users with the first performance metric of the first user, wherein a computational cost of comparing the respective second performance metric of each of the second quantity of users with the first performance metric of the first user is based at least in part on the second quantity of users; and causing to be displayed, on a display of the first exercise device, during execution of the workout program by the first user, a leaderboard indicative of the comparison of the first performance metric of the first user and the respective second performance metric of each of the second quantity of users in the selected subset of the plurality of simulated users.

16. The method of claim 15, wherein the leaderboard indicative of the comparison of the first performance metric of the first user and the respective second performance metric of each of the second quantity of users in the selected subset of the plurality of simulated users comprises a ranking of the first user and the selected subset of the plurality of simulated users.

17. The method of claim 16, wherein an order of the first user and the selected subset of the plurality of simulated users on the leaderboard is determined based on the first performance metric of the first user and the respective second performance metric of each of the second quantity of users in the selected subset of the plurality of simulated users.

18. The method of claim 16, wherein an order of the first user and the selected subset of the plurality of simulated users on the leaderboard is determined based on one or more user parameters of the first user and the selected subset of the plurality of simulated users.

19. The method of claim 16, further comprising:

in response to receiving input from the first user selecting a performance metric, display, on the display of the first exercise device, a comparison of the selected performance metric of the first user and the selected performance metric of the selected subset of the plurality of simulated users.

20. The method of claim 16, wherein selecting the subset of the ranked plurality of simulated users comprises applying a filter selected by the first user.

* * * * *